US012059084B2

(12) United States Patent
Hua

(10) Patent No.: US 12,059,084 B2
(45) Date of Patent: Aug. 13, 2024

(54) MERCHANDISE SECURITY SYSTEM

(71) Applicant: Fasteners for Retail, Inc., Twinsburg, OH (US)

(72) Inventor: Yun Hua, Solon, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/061,554

(22) Filed: Dec. 5, 2022

(65) Prior Publication Data

US 2023/0172372 A1 Jun. 8, 2023

Related U.S. Application Data

(60) Provisional application No. 63/265,000, filed on Dec. 6, 2021.

(51) Int. Cl.
*A47F 5/00* (2006.01)
*A47B 57/58* (2006.01)

(52) U.S. Cl.
CPC ..... *A47F 5/005* (2013.01); *A47B 57/583* (2013.01)

(58) Field of Classification Search
CPC ..... A47F 5/005; A47F 1/12; A47F 5/0068; A47B 57/586; A47B 57/583; A47B 57/585; A47B 57/58; A47B 57/588; A47B 65/15; A47B 96/04
USPC ..... 211/59.4, 119.003, 184
See application file for complete search history.

(56) References Cited

U.S. PATENT DOCUMENTS 3,512,652 A * 5/1970 Armstrong ..... G09F 3/20 312/140.3
4,615,276 A * 10/1986 Garabedian ..... A47F 5/005 211/184
4,775,058 A * 10/1988 Yatsko ..... A47F 5/005 211/184
4,830,201 A * 5/1989 Breslow ..... A47F 1/126 211/59.3
5,088,607 A * 2/1992 Risafi ..... A47F 1/125 211/59.3
5,341,945 A * 8/1994 Gibson ..... A47F 5/005 211/184
5,408,775 A * 4/1995 Abramson ..... G09F 3/18 40/655
5,450,968 A * 9/1995 Bustos ..... A47F 5/005 211/187

(Continued)

FOREIGN PATENT DOCUMENTS

EP 2789271 A1 10/2014
NL 9000404 A 9/1991

(Continued)

OTHER PUBLICATIONS

EPO. Partial Search Results relating to Applicaiton No. PCT/US2022/080893, dated Mar. 22, 2023.

*Primary Examiner* — Jennifer E. Novosad
(74) *Attorney, Agent, or Firm* — Honigman LLP

(57) ABSTRACT

A merchandise security system comprises a divider rail, a tile rail selectively engaged with the divider rail, one or more dividers slidably engaged with the divider rail, and one or more tiles slidably engaged with the tile rail, the one or more tiles configured to extend in a vertical direction relative to a base surface and the one or more tiles configured to slide along the tile rail in a horizontal direction perpendicular to the vertical direction.

9 Claims, 26 Drawing Sheets

(56) References Cited

U.S. PATENT DOCUMENTS 5,918,842 A * 7/1999 Garfinkle ..... A47F 5/0068 248/223.41
6,047,647 A * 4/2000 Laraia, Jr. ..... A47B 57/58 211/184
6,227,385 B1 * 5/2001 Nickerson ..... A47F 1/126 211/59.3
6,796,445 B2 * 9/2004 Cyrluk ..... G09F 3/204 211/183
6,932,226 B2 * 8/2005 Hardy ..... A47F 5/0068 248/225.11
7,063,217 B2 * 6/2006 Burke ..... A47F 1/126 211/119.003
7,395,938 B2 * 7/2008 Merit ..... A47F 1/126 211/184
7,850,022 B2 * 12/2010 Fulmer ..... H05K 7/1425 211/186
8,152,006 B2 * 4/2012 Wamsley ..... A47F 5/005 211/119.003
8,622,227 B2 * 1/2014 Bird ..... A47F 3/002 211/119.003
8,627,965 B2 * 1/2014 Hardy ..... A47F 1/126 211/59.3
8,746,468 B2 * 6/2014 Poulokefalos ..... A47F 5/005 211/59.3
8,973,765 B2 * 3/2015 Wamsley ..... A47F 1/04 211/119.003
9,016,482 B2 * 4/2015 Kim ..... A47F 1/126 211/59.2
9,451,836 B2 * 9/2016 Szpak ..... A47F 5/005
9,820,585 B2 * 11/2017 Hardy ..... A47F 5/005
9,955,802 B2 * 5/2018 Bird ..... A47B 57/585
10,178,909 B2 * 1/2019 Hardy ..... A47F 7/0007
10,398,239 B1 * 9/2019 Luberto ..... A47F 5/0025
10,959,540 B2 * 3/2021 Padvoiskis ..... A47B 57/586
11,160,392 B2 * 11/2021 Ewing ..... A47F 5/005
11,259,652 B2 * 3/2022 Hardy ..... A47F 1/12
11,540,628 B2 * 1/2023 Brück ..... G08B 13/1436
11,583,109 B2 * 2/2023 Hardy ..... A47F 5/0068
11,744,387 B1 * 9/2023 Kerr ..... A47F 5/105 206/307
2005/0077260 A1 * 4/2005 Mueller ..... A47F 1/126 211/59.3
2005/0139560 A1 * 6/2005 Whiteside ..... A47B 57/586 211/119.003
2006/0260518 A1 * 11/2006 Josefsson ..... G09F 3/204 108/61
2007/0187344 A1 * 8/2007 Mueller ..... A47F 1/126 211/59.3
2009/0277853 A1 * 11/2009 Bauer ..... A47F 1/087 211/59.3
2014/0263134 A1 * 9/2014 Walker ..... A47B 57/58 211/184
2021/0052087 A1 * 2/2021 Nagel ..... A47F 1/126
2021/0298470 A1 * 9/2021 Lanphear ..... A47B 96/021
2022/0369831 A1 * 11/2022 Bruegmann ..... A47F 5/0068
2023/0172372 A1 * 6/2023 Hua ..... A47F 5/005 211/59.4
2023/0210277 A1 * 7/2023 Ewing ..... G06K 7/1417 705/28
2023/0337839 A1 * 10/2023 Walker ..... A47F 1/126

FOREIGN PATENT DOCUMENTS

WO 0078180 A2 12/2000
WO 2005034693 A1 4/2005

* cited by examiner

MERCHANDISE SECURITY SYSTEM

CROSS REFERENCE TO RELATED APPLICATION

This application claims priority under 35 U.S.C. § 119(e) to U.S. Provisional Patent Application 63/265,000, filed on Dec. 6, 2021, the disclosure of this prior application is considered part of the disclosure of this application and is hereby incorporated by reference in its entirety.

FIELD

The present disclosure relates generally to merchandise security systems.

BACKGROUND

This section provides background information related to the present disclosure and is not necessarily prior art.

In self-service retail establishments, such as drug stores, grocery stores and the like, articles are usually displayed for sale on racks consisting of vertically spaced shelves on which the articles are arranged in rows. Although merchandise in such retail environments is accessible substantially only from the front, the shelves previously employed have permitted free access to the space above the merchandise supported on each shelf. In this way, a person who wished to do so could very quickly and easily remove a large number of articles at one time. It is known for thieves to "sweep" a shelf with their arm, collecting the items into a purse, bag or coat very quickly and exit a store, without drawing attention to themselves. This is particularly a problem with high-value goods, such as razor blades, pharmaceuticals, batteries, cigarettes, perfumes and the like. A thief could steal as much as several hundred dollars' worth of merchandise with very little effort and without great risk of being detected. Similar theft problems exist for merchandise displayed on hooks mounted on pegboards or the like.

SUMMARY

One aspect of the disclosure provides merchandise security system for a retail shelf. The system includes a divider rail, a tile rail selectively coupled with the divider rail, a divider engaged with the divider rail and at least partially defining a first product receiving area and a second product receiving area, and one or more tiles slidably engaged with the tile rail and operable to translate along the rail from a first position corresponding to the first product receiving area to a second position corresponding to the second product receiving area.

Implementations of the disclosure may include one or more of the following optional features. In some examples, the one or more tiles are selectively engaged with the divider rail. Here, the divider may include a first set of teeth and the divider rail may include a second set of teeth, the first set of teeth being configured to selectively engage the second set of teeth.

In some implementations, the tile rail includes a third set of teeth and the tiles each include one or more fingers configured to selectively engage the third set of teeth. Here, the selective engagement of the one or more fingers with the third set of teeth is configured to provide audible feedback when the one or more tiles are translated from the first position to the second position.

In some configurations, the tile rail defines a tile track configured to receive each of the tiles, and each of the tiles include a bearing rail that is configured to engage the tile track. Optionally, the tile track and the bearing rail are both generally T-shaped. In some implementations, the tile track is defined by a pair of flanges that have a generally bulbous shape that is configured to reduce sliding friction between the guide rail and the flanges. In some examples, the divider rail includes a rear wall and a front wall spaced apart from the rear wall by a channel, the front wall defining a slot configured to selectively receive a portion of the tile rail. In some configurations, the slot includes a first terminal end defining a socket configured to provide a snap fit with the portion of the tile rail.

Another aspect of the disclosure provides a merchandise security system having a divider rail including a front wall including an accessory slot, a tile rail selectively engaged with the accessory slot and defining a tile track, and one or more tiles including a bearing rail that is slidably engaged with the tile track, the one or more tiles configured to translate along the tile rail.

Implementations of this aspect of the disclosure may include one or more of the following optional features. In some examples, the system includes a divider selectively engaged with the divider rail. Optionally, the divider includes a first set of teeth and the divider rail includes a second set of teeth, the first set of teeth being configured to selectively engage the second set of teeth. In some implementations, the tile rail includes a third set of teeth and the tiles include a pair of fingers configured to selectively engage the third set of teeth. In some examples, the selective engagement of the pair of fingers with the third set of teeth is configured to provide audible feedback when the one or more tiles are translated along the tile rail.

In some configurations, the tile track and the bearing rail are both generally T-shaped. In some examples, the tile track is defined by a pair of flanges that have a generally bulbous shape that is configured to reduce sliding friction between the guide rail and the tile track. In some implementations, the divider rail, the tile rail, and the one or more dividers are configured to be installed on a base surface of a shelf.

Optionally, the front wall of the divider rail extends from a base of the divider rail and includes a first portion and a second portion spaced apart from the first portion to define an opening of the slot facing the base of the divider rail. In some examples, the slot extends from the opening to a terminal end defining a socket configured to provide a snap fit with the tile rail.

Another aspect of the disclosure provides a tile for a merchandise security system The tile includes a base and a front wall attached to the base and operable between a retracted configuration where the front wall is spaced a first distance from the base and an extended configuration where the front wall is spaced a second distance from the base.

This aspect of the disclosure may include one or more of the following optional features. In some examples, the base includes a bottom wall having a bearing rail attached to a first side of the bottom wall. In some implementations, the base includes a sidewall extending from a second side of the bottom wall. In some configurations, the base includes a sidewall defining a receiver configured to slidably receive a portion of the front wall. In some examples, the front wall includes a tongue slidably received within the receiver of the base.

In some configurations, the base defines an adjustment element configured to secure a configuration of the base in one of the extended configuration and the retracted configuration. Here, the front wall includes a locking element configured to engage the adjustment element of the base to secure the configuration of the base in one of the extended configuration and the retracted configuration. In some configurations, the adjustment element includes a plurality of teeth arranged in series and the locking element includes a resilient prong including a locking feature selectively engaged with the plurality of teeth. In some configurations, at least one of the plurality of teeth and the locking feature includes a beveled surface configured to bias the locking feature away from the adjustment element as the front wall moves to the retracted configuration. In some examples, the base includes one or more resilient fingers extending in an opposite direction from the front wall.

Another aspect of the disclosure provides a tile for a merchandise security system. The tile includes a base, and a front wall attached to the base and operable between a shortened configuration where the front wall has a first height and a lengthened configuration wherein the front wall has a second height.

Implementations of this aspect of the disclosure may include one or more of the following optional features. In some examples, the front wall includes a lower wall slidably attached to the base and an upper wall slidably attached to the lower wall. In some examples, the lower wall includes one of a guide track and a guide rail and the upper wall includes the other of the guide track and the guide rail slidingly engaged with the one of the guide track and the guide rail of the lower wall. In some implementations, the lower wall includes one of a vertical positioning element and the upper wall includes a vertical locking element selectively engaged with the vertical positioning element to secure a vertical position of the upper wall relative to the lower wall. Here, the vertical positioning element may include a plurality of apertures and the vertical locking element includes a fastener engaged with one of the plurality of apertures. In some examples, the fastener is a pin. In some implementations, the fastener is a resilient prong coupled to one of the upper wall or the lower wall.

In some examples, the base includes a carriage having a bearing rail. In some implementations, the carriage includes a receiver and the lower wall includes a tongue slidingly received within the receiver of the carriage. In some configurations, the lower wall is operable to move between an extended configuration and a retracted position.

This section provides a general summary of the disclosure, and is not a comprehensive disclosure of its full scope or all of its features.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Figure 17:
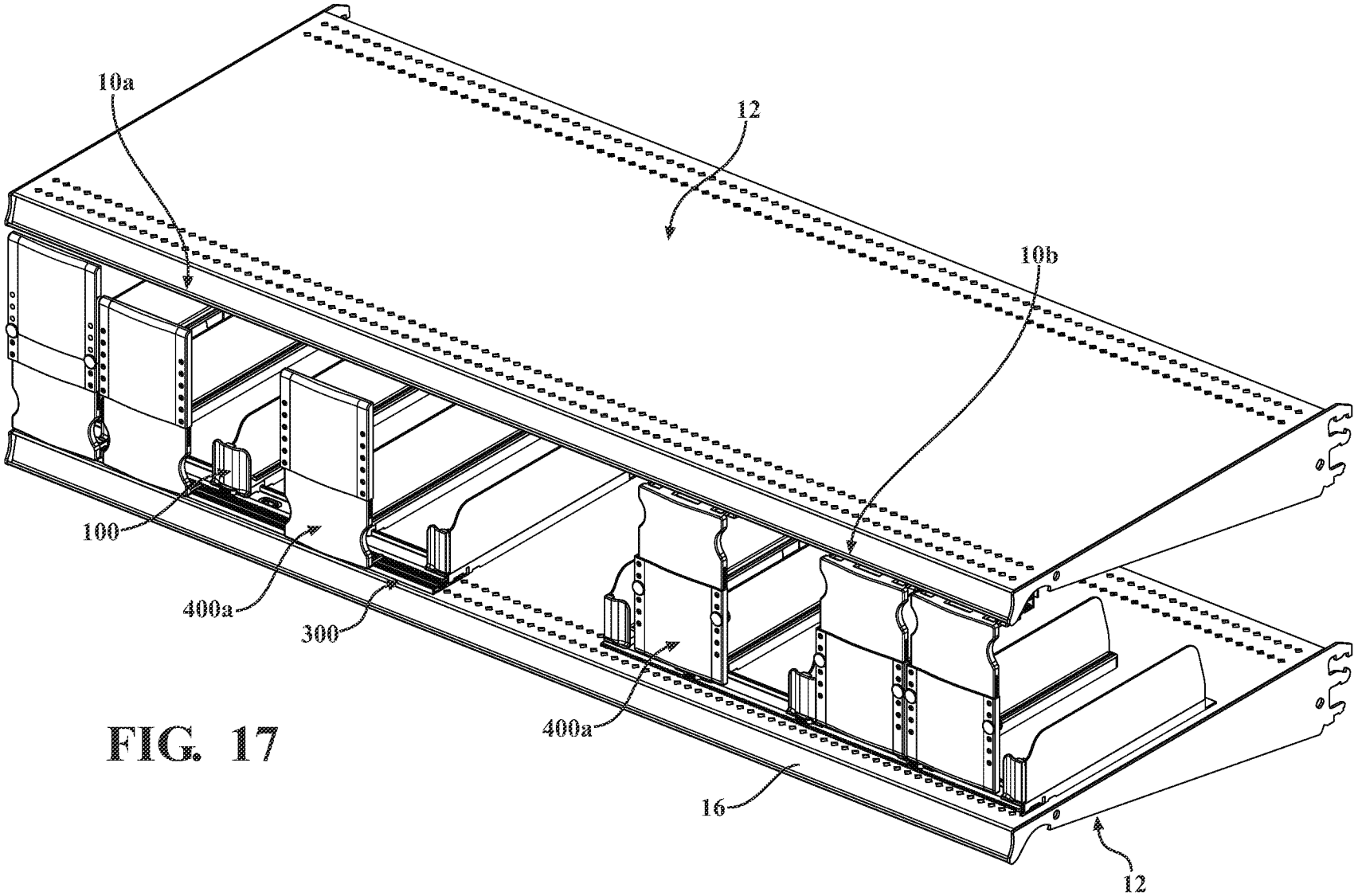
Figure 18:
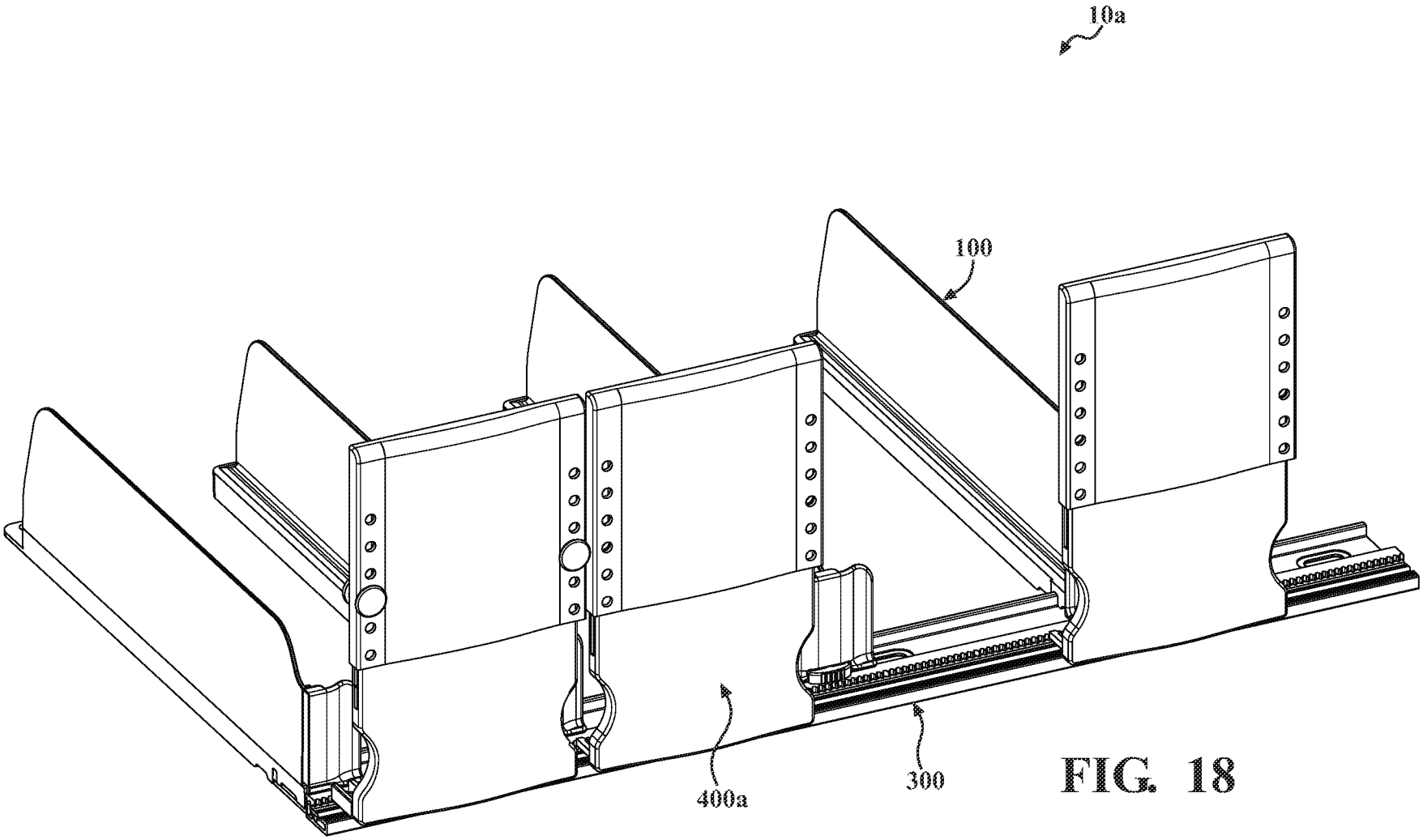
Figure 19:
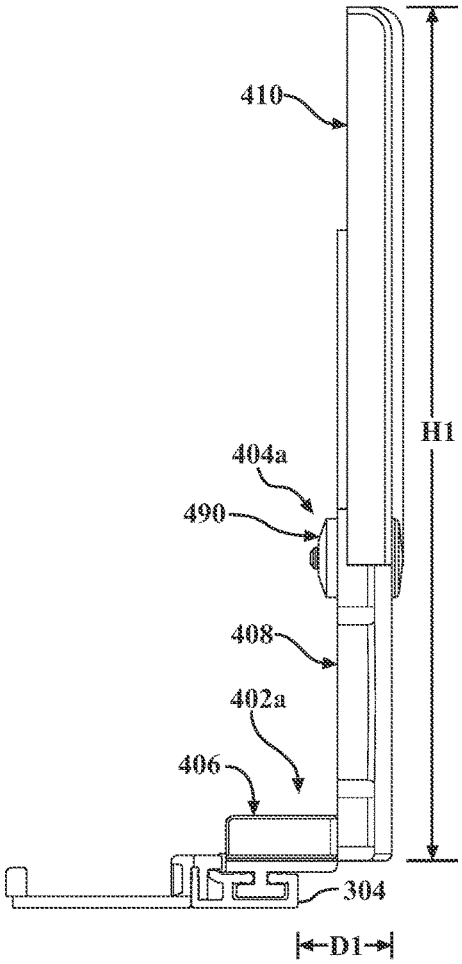
Figure 20:
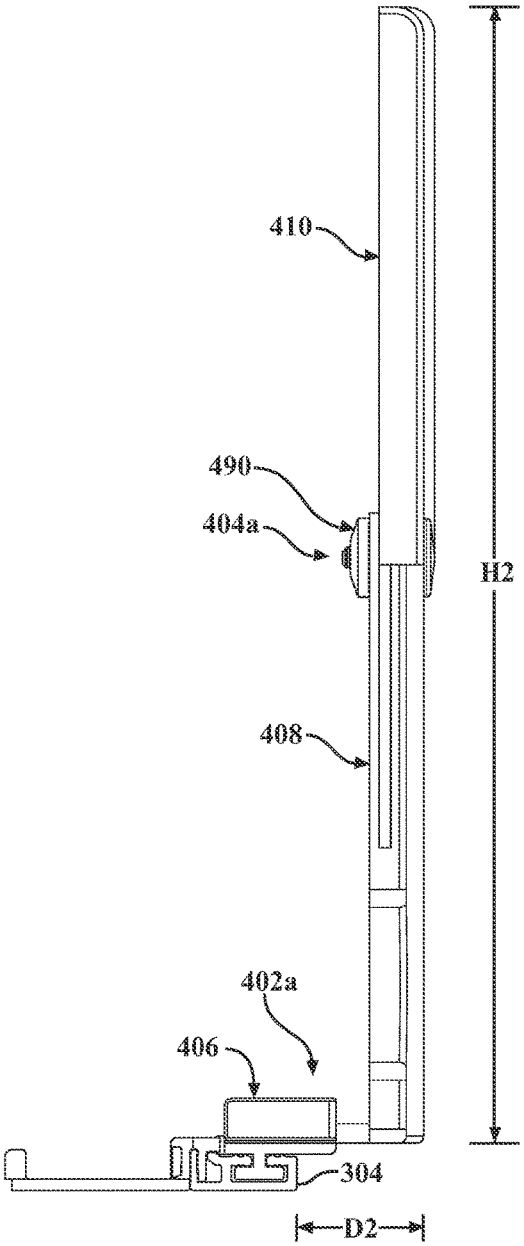
Figure 21:
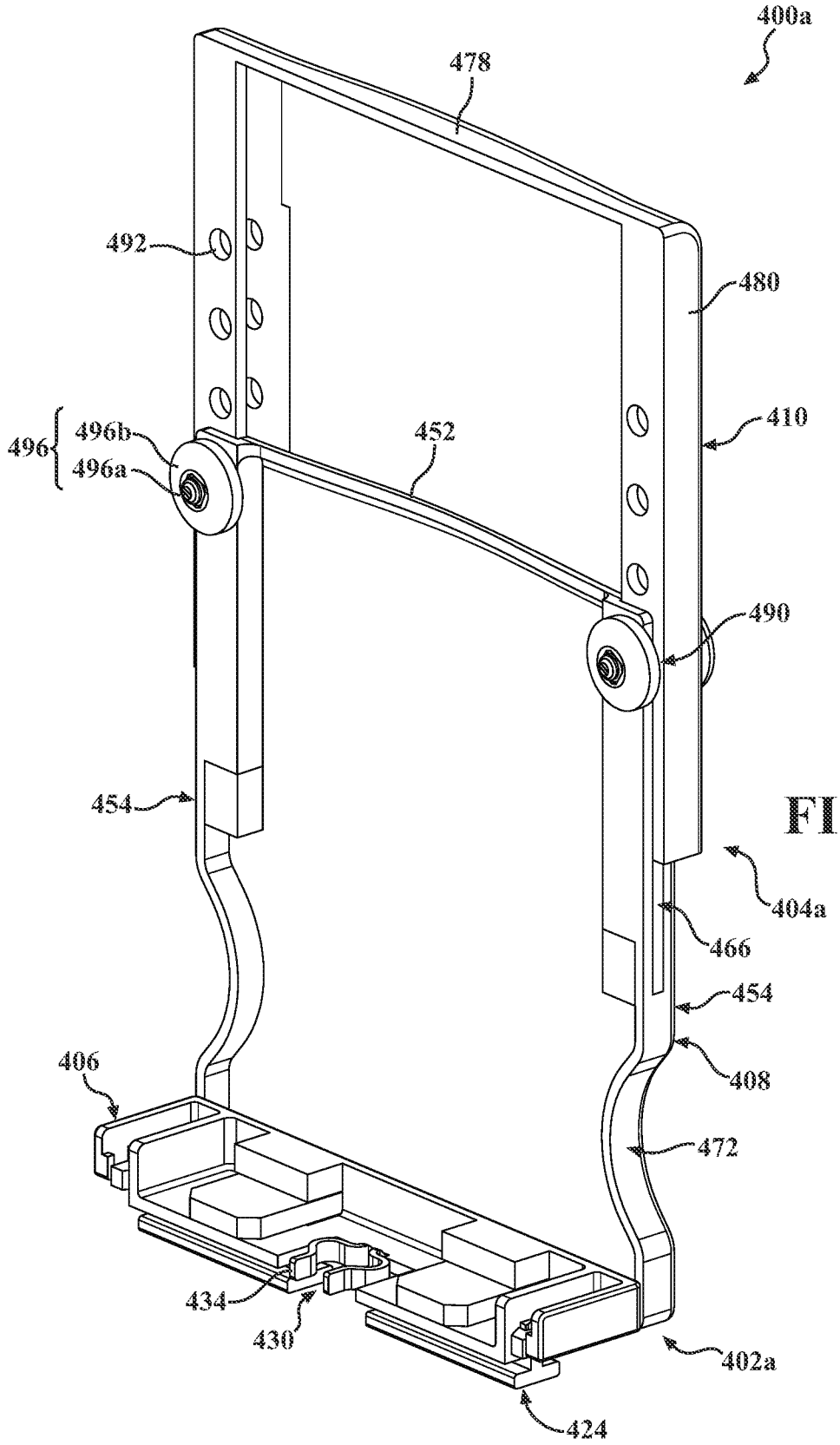
Figure 22:
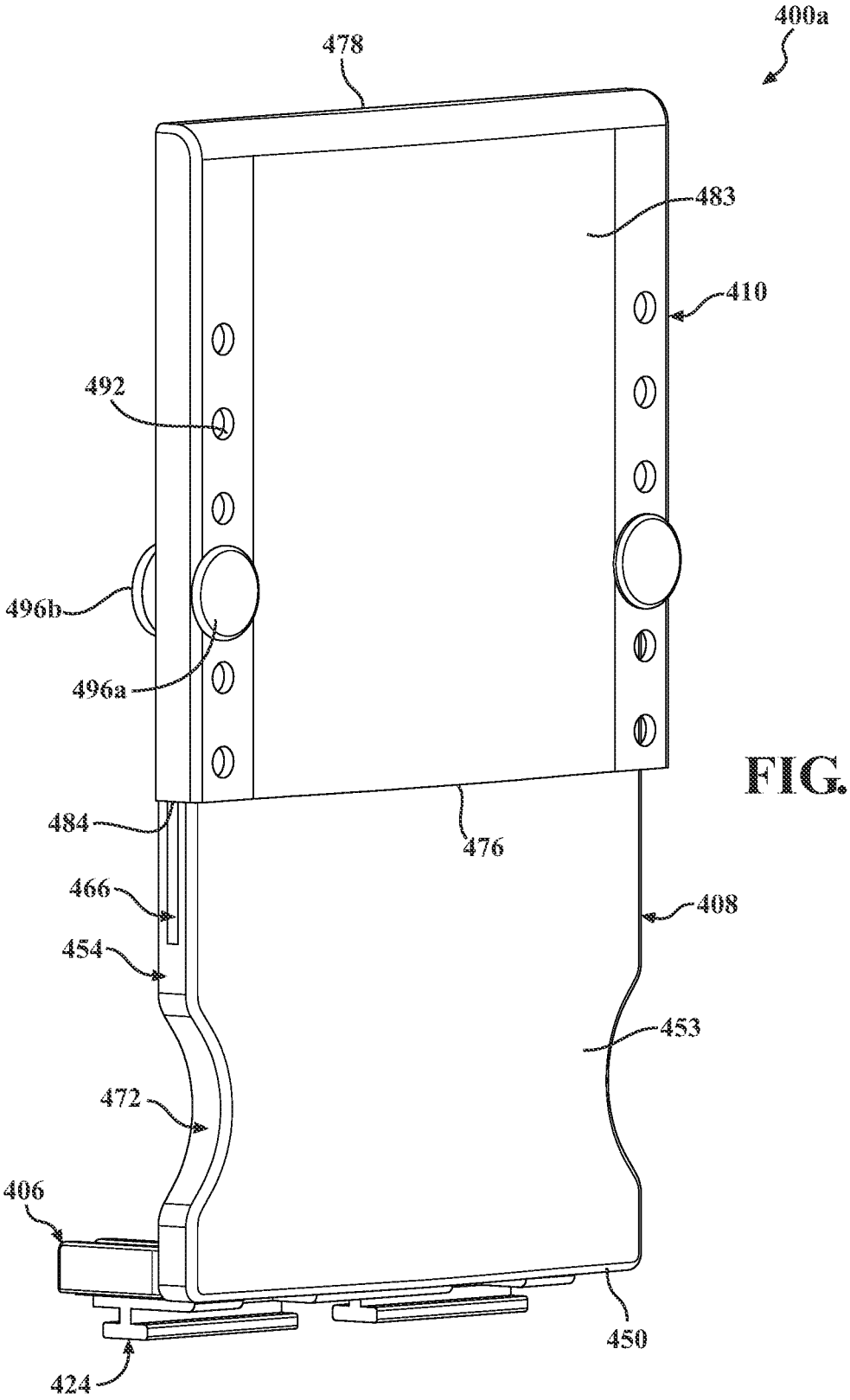
Figure 23:
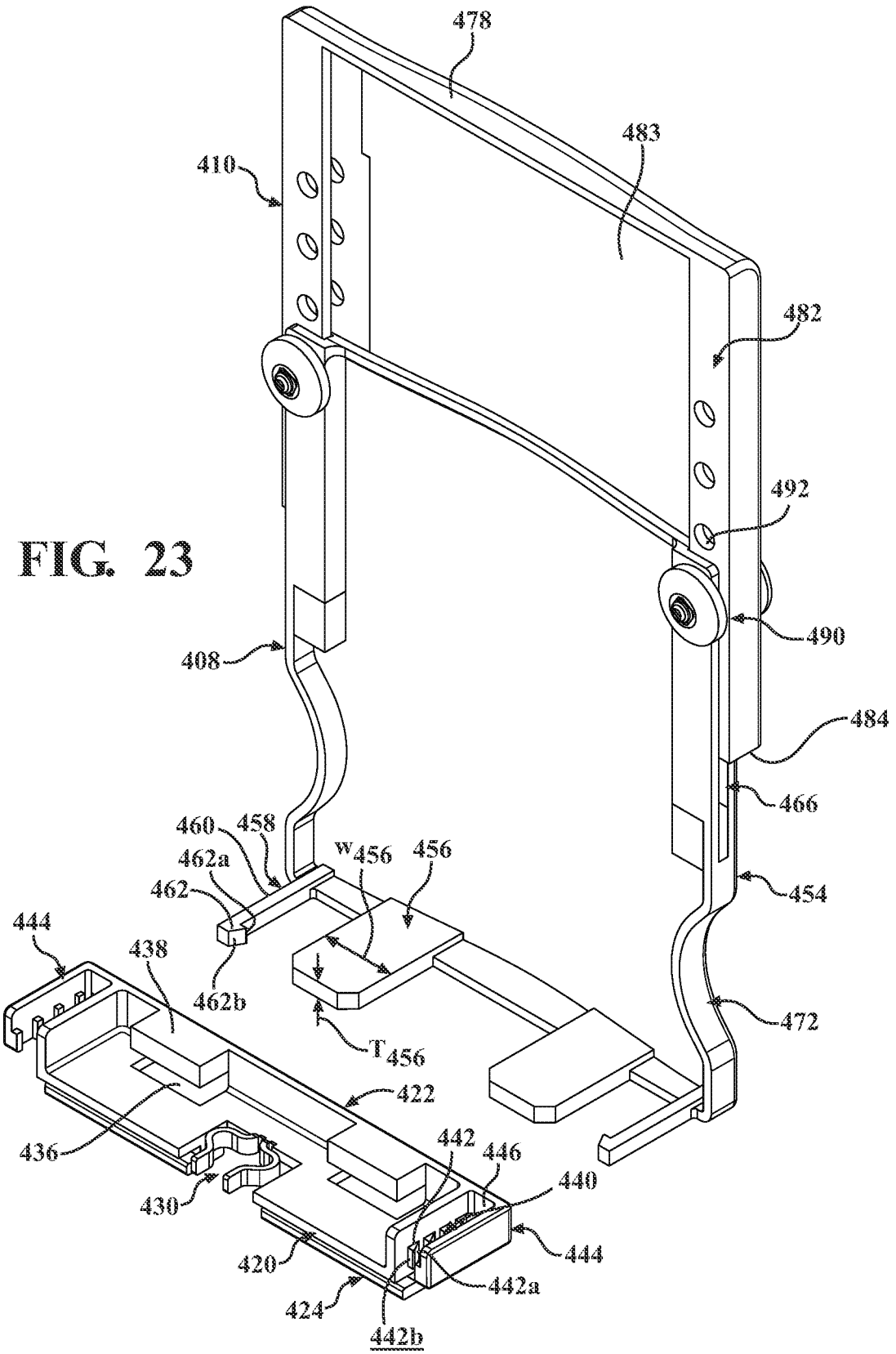
Figure 24:
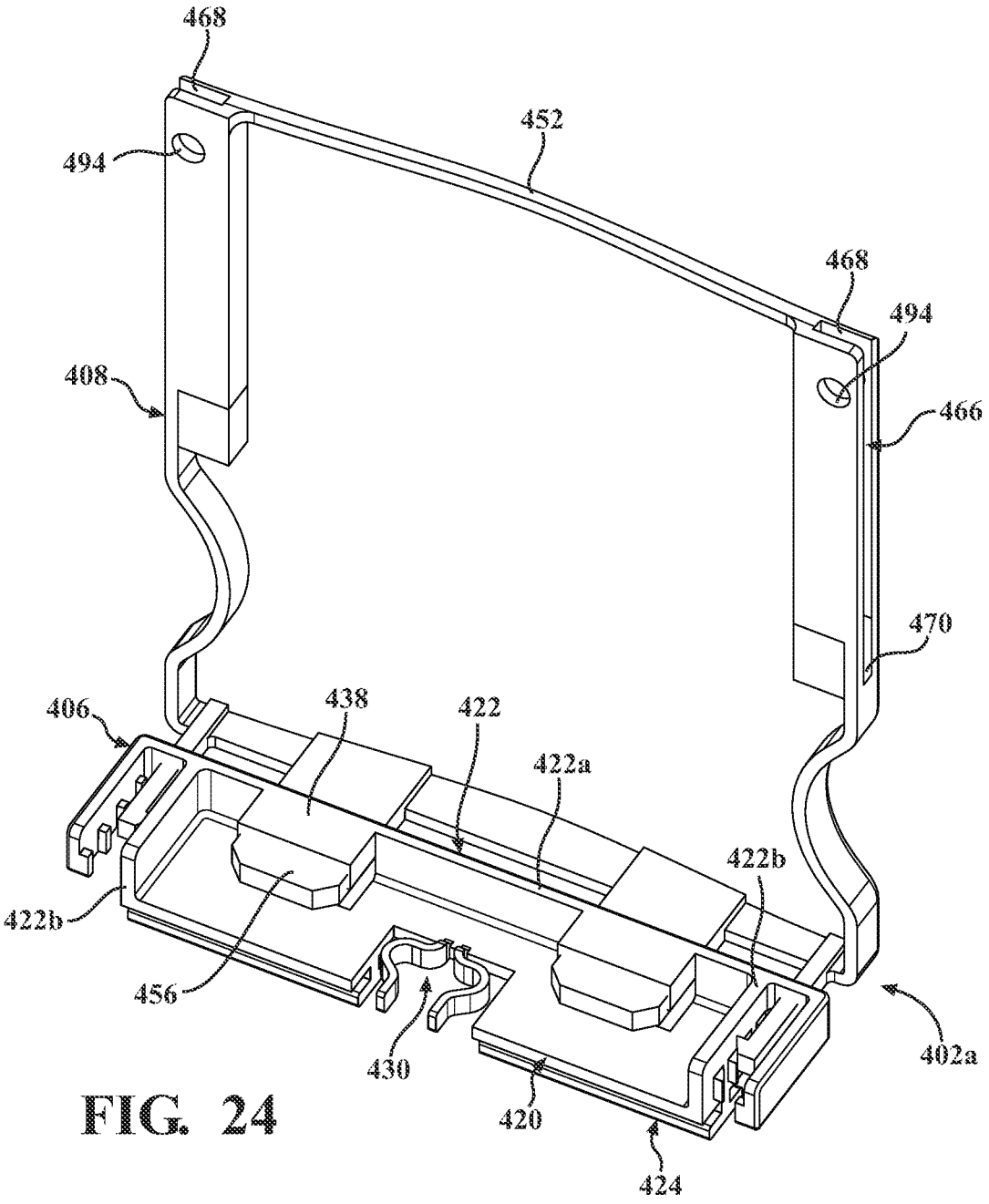
Figure 25:
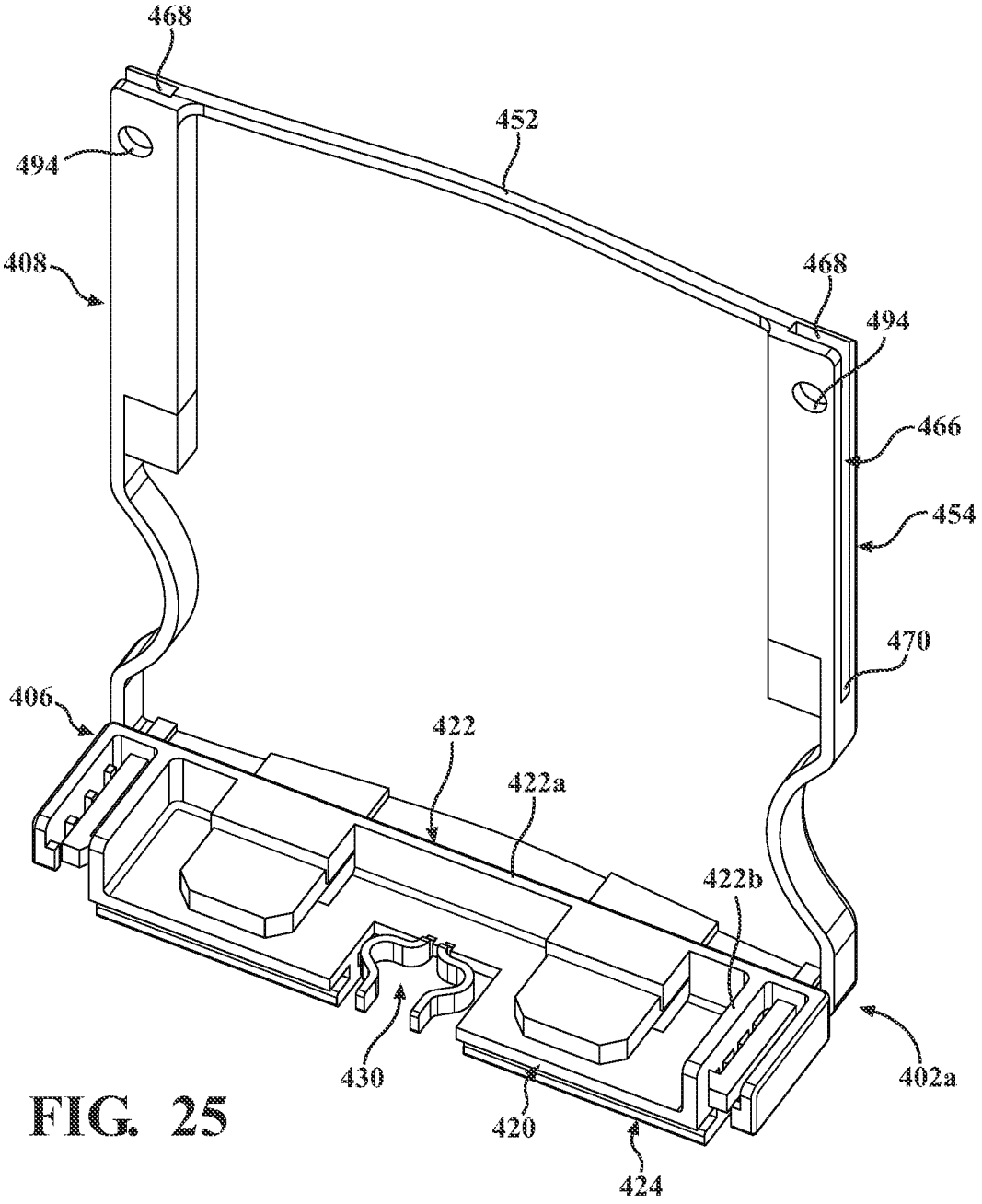
Figure 27:
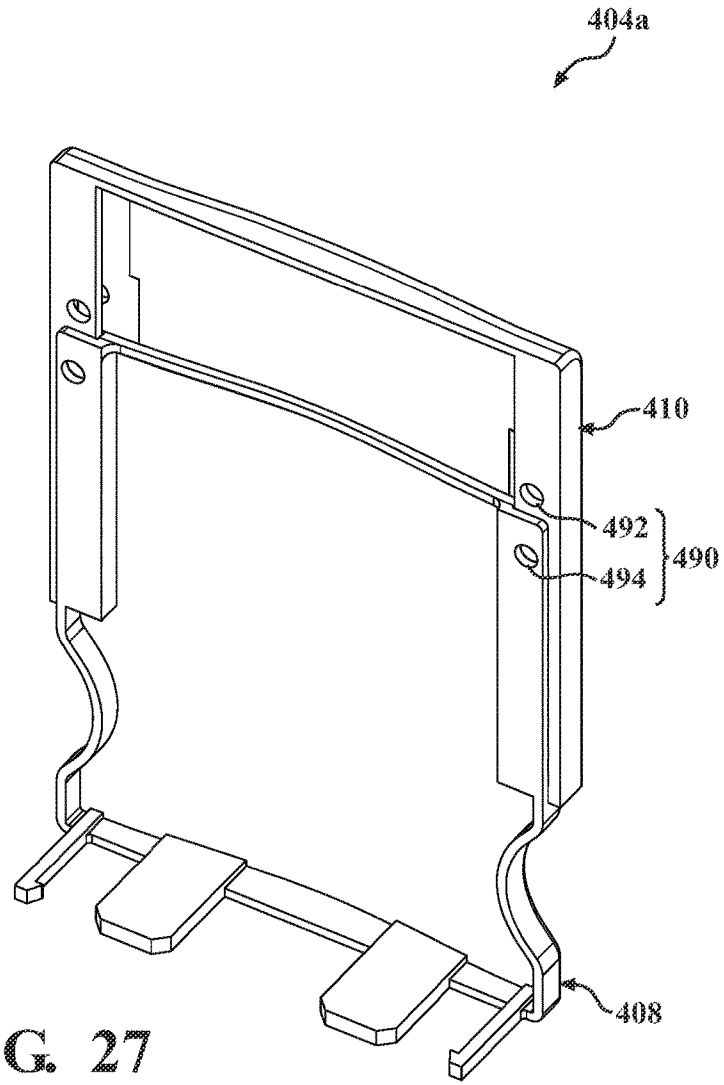
Figure 26:
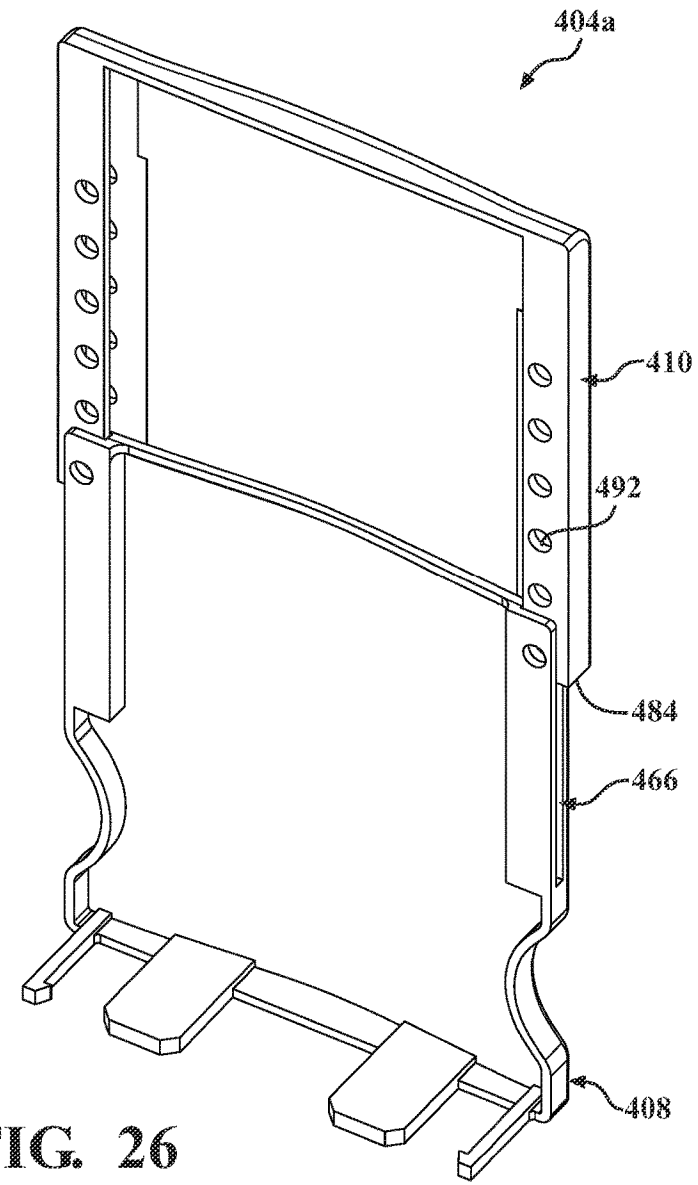
Figure 29:
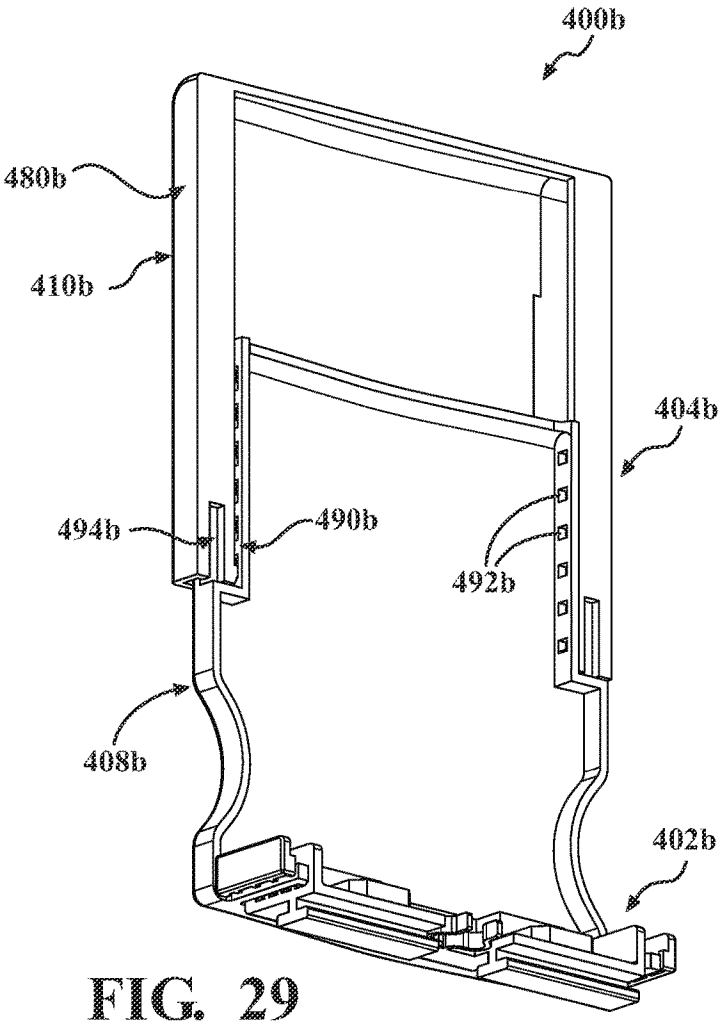
Figure 28:
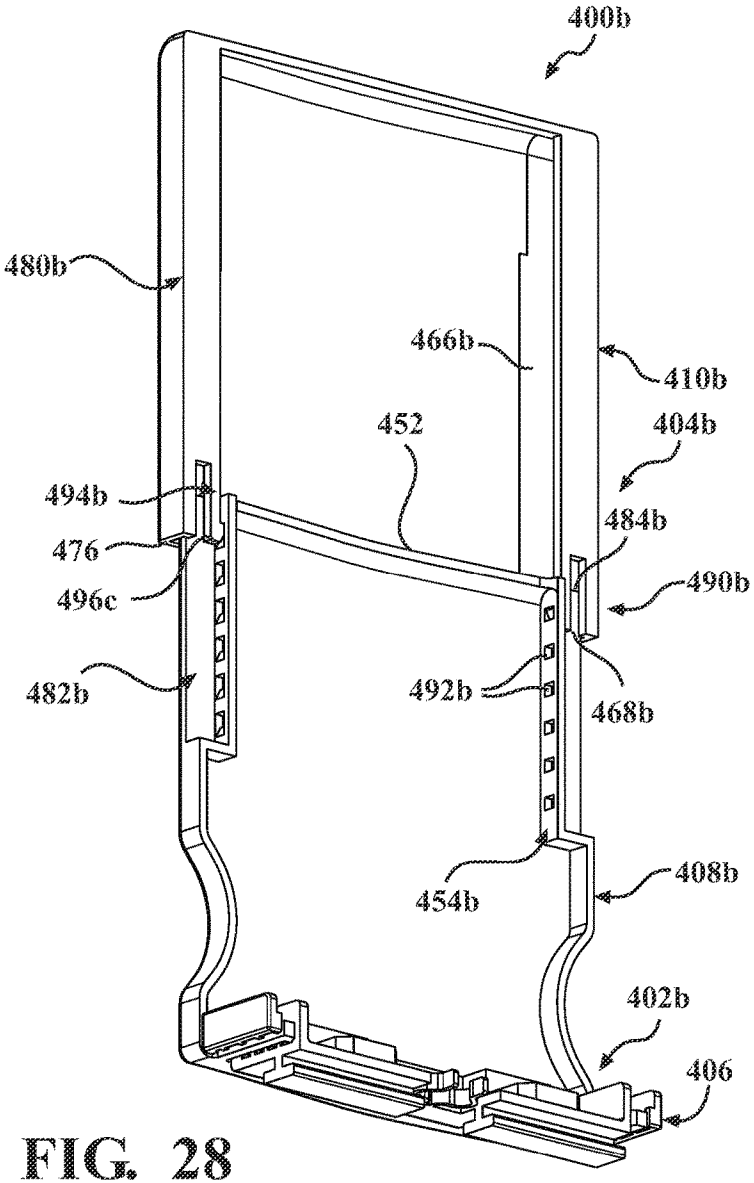
Figure 30:
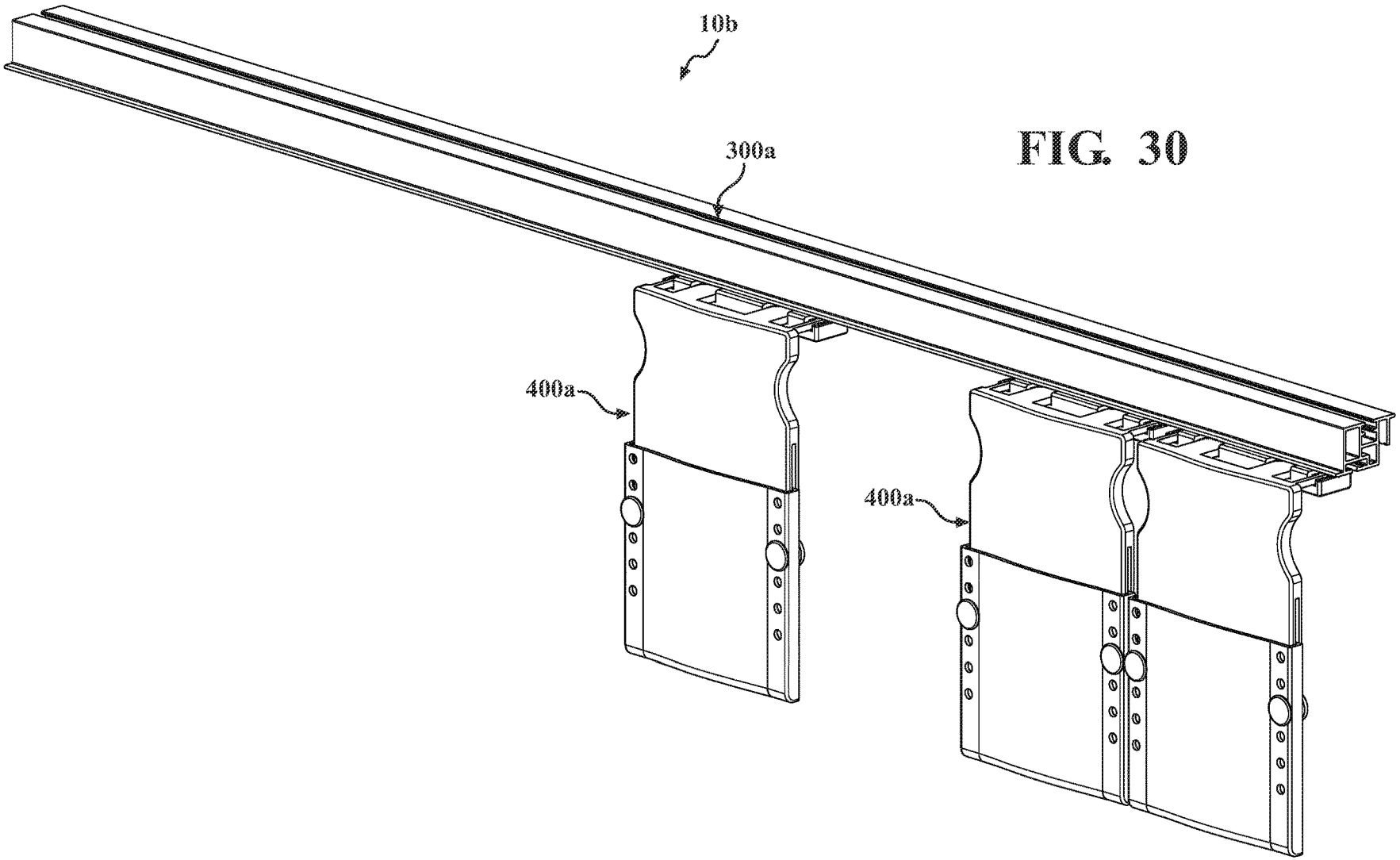

FIG. 17 a perspective view of a plurality of merchandise security assemblies on a shelf or other surface according to an example of the present disclosure;

FIG. 18 is a front perspective view of a merchandise security system of FIG. 17;

FIG. 19 is a side elevation view of an adjustable tile for the security system of FIG. 18, where the adjustable tile is in a first configuration;

FIG. 20 is a side elevation view of an adjustable tile for the security system of FIG. 18, where the adjustable tile is in a second configuration;

FIG. 21 is a rear perspective view of an example of an adjustable tile according to the present disclosure;

FIG. 22 is a front perspective view of the adjustable tile of FIG. 21;

FIG. 23 is a partially exploded, rear perspective view of the adjustable tile of FIG. 21;

FIG. 24 is a fragmentary rear perspective view of the adjustable tile of FIG. 21 showing a base of the adjustable tile in an extended configuration;

FIG. 25 is a fragmentary rear perspective view of the adjustable tile of FIG. 21 showing a base of the adjustable tile in a retracted configuration;

FIG. 26 is a fragmentary rear perspective view of the adjustable tile of FIG. 21 showing a front wall of the adjustable tile in a lengthened configuration;

FIG. 27 is a fragmentary rear perspective view of the adjustable tile of FIG. 21 showing a front wall of the adjustable tile in a shortened configuration;

FIG. 28 is a rear perspective view of another example of an adjustable tile according to the present disclosure, where a front wall of the adjustable tile is in a lengthened configuration;

FIG. 29 is a rear perspective view of another example of an adjustable tile according to the present disclosure, where a front wall of the adjustable tile is in a shortened configuration; and FIG. 30 is a front perspective view of another merchandise security system of FIG. 17.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
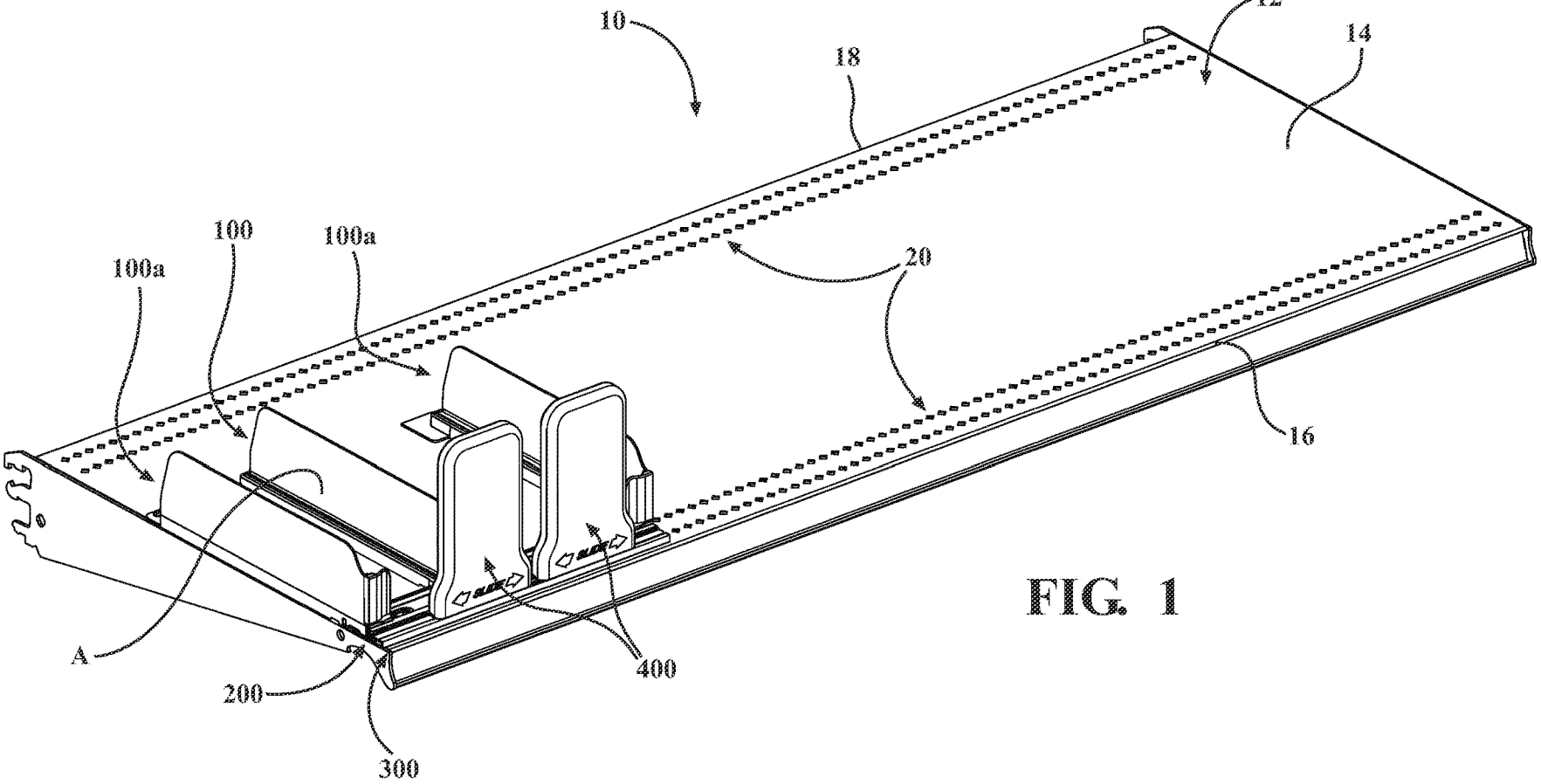
FIG. 1 is a perspective view of a plurality of merchandise security assemblies on a shelf or other surface according to an example of the present disclosure.
Figure 2:
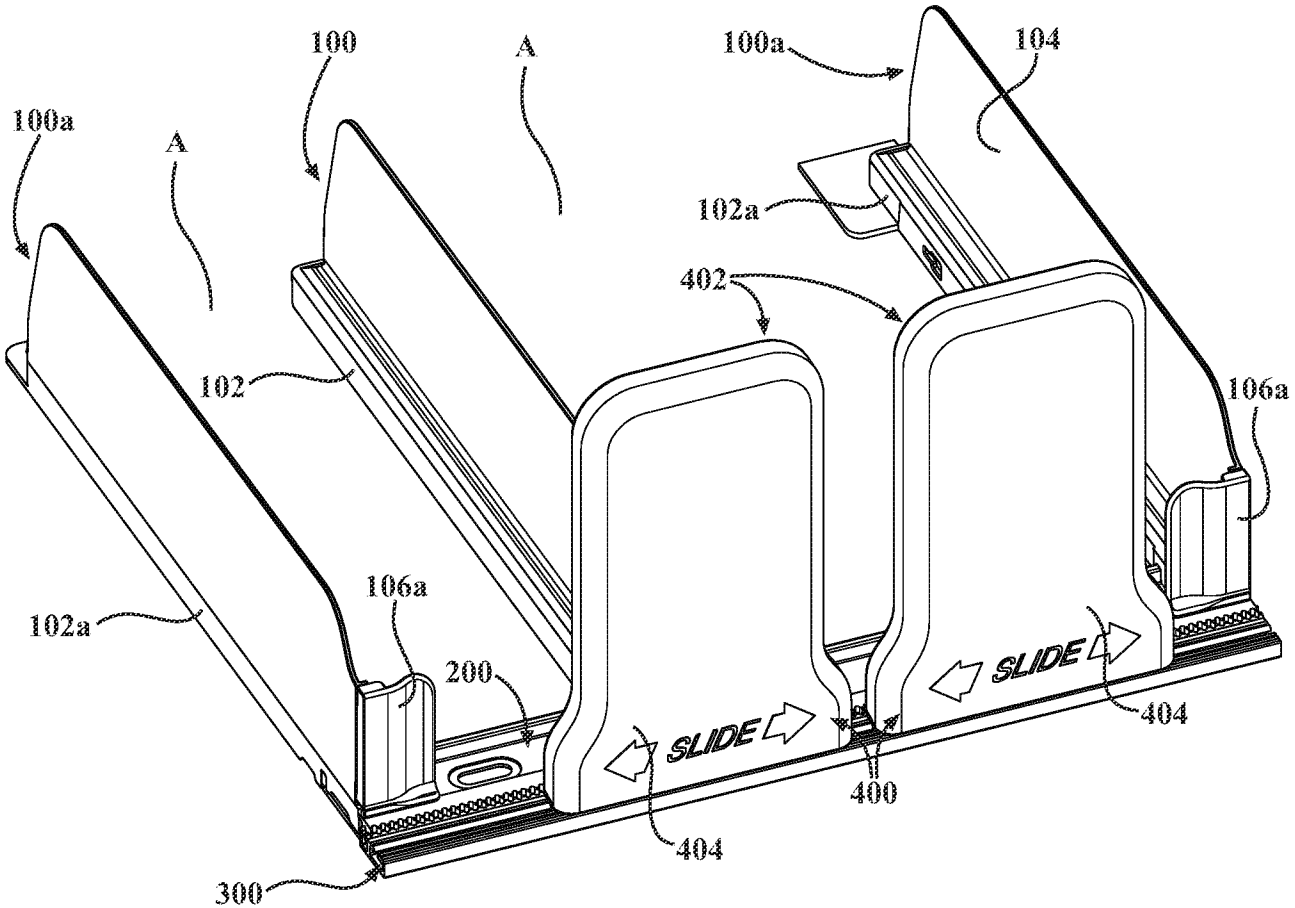
FIG. 2 is a front perspective view of the merchandise security system of FIG. 1.

Referring to FIG. 1, a merchandise security system or assembly 10 is generally shown. The assembly 10 may be installed on a top surface 14 of a shelf 12, or other suitable base surface. The shelf 12 may be located in a store or other suitable location where consumers are able to purchase merchandise. As shown in FIG. 1, the top surface 14 of the shelf 12 extends along from a front edge 16 to an opposite rear edge 18. As discussed throughout, the direction from the front edge 16 to the rear edge 18 defines a longitudinal direction while the direction parallel to the front edge 16 and the rear edge 18 defines a lateral direction. In some implementations, the shelf 12 may include apertures 20 extending through the surface 14 and arranged in series adjacent to each of the front edge 16 and the rear edge 18 of the shelf 12. Portions of the assembly 10 may be secured to the shelf 12 via fasteners engaging with the apertures 20. The assembly 10 may be secured to the shelf 12 in any suitable manner, and the assembly 10 may be selectively detached from the shelf 12 and moved, for example, to another shelf or other surface.

The assembly 10 includes one or more dividers 100, 100*a*, a divider rail 200, a tile rail 300, and one or more tiles 400. With the assembly 10 installed on a shelf 12, any suitable merchandise may be positioned within a product receiving area A defined between adjacent ones of the dividers 100 and behind the tiles 400. The tiles 400 are selectively positionable at a first end of the product receiving area A between adjacent dividers 100 to prohibit the ability for a thief or other malcontent from "sweeping" the shelf and removing large quantities of the merchandise, as will be described in greater detail below.

In the illustrated example, the assembly 10 includes a central divider 100 and a pair of end dividers 100*a*. The central divider 100 includes a base member 102, a divider wall 104, and an end wall 106. The base member 102 abuts the top surface 14 of the shelf 12 and may be positioned to extend along a direction from the front edge 16 of the shelf 12 to the rear edge 18 of the shelf 12. The divider wall 104 extends from the base member 102 in a transverse direction relative to top surface 14 of the shelf 12. The end wall 106 is connected to the divider wall 104 and positioned to be at or near the front of the divider 100, i.e., the end wall 106 is facing the customer's vantage point. The base member 102, the divider wall 104, the end wall 106, and the surface 14 of the shelf 12 cooperate to contain merchandise or other suitable products. As just one example, the merchandise may be contained in a series of rectangular boxes and the foregoing elements substantially contain the rectangular boxes in a row within the product receiving area A on the shelf 12. That is, the merchandise may abut or be slightly spaced apart from adjacent side walls 104, and the specific merchandise that is at the front of the product receiving area A may abut or be slightly spaced apart from the end wall 106. The end dividers 100*a* may include a base member 102*a*, the divider wall 104, and an end wall 106*a* having a similar configuration to the central divider 100.

Figure 3:
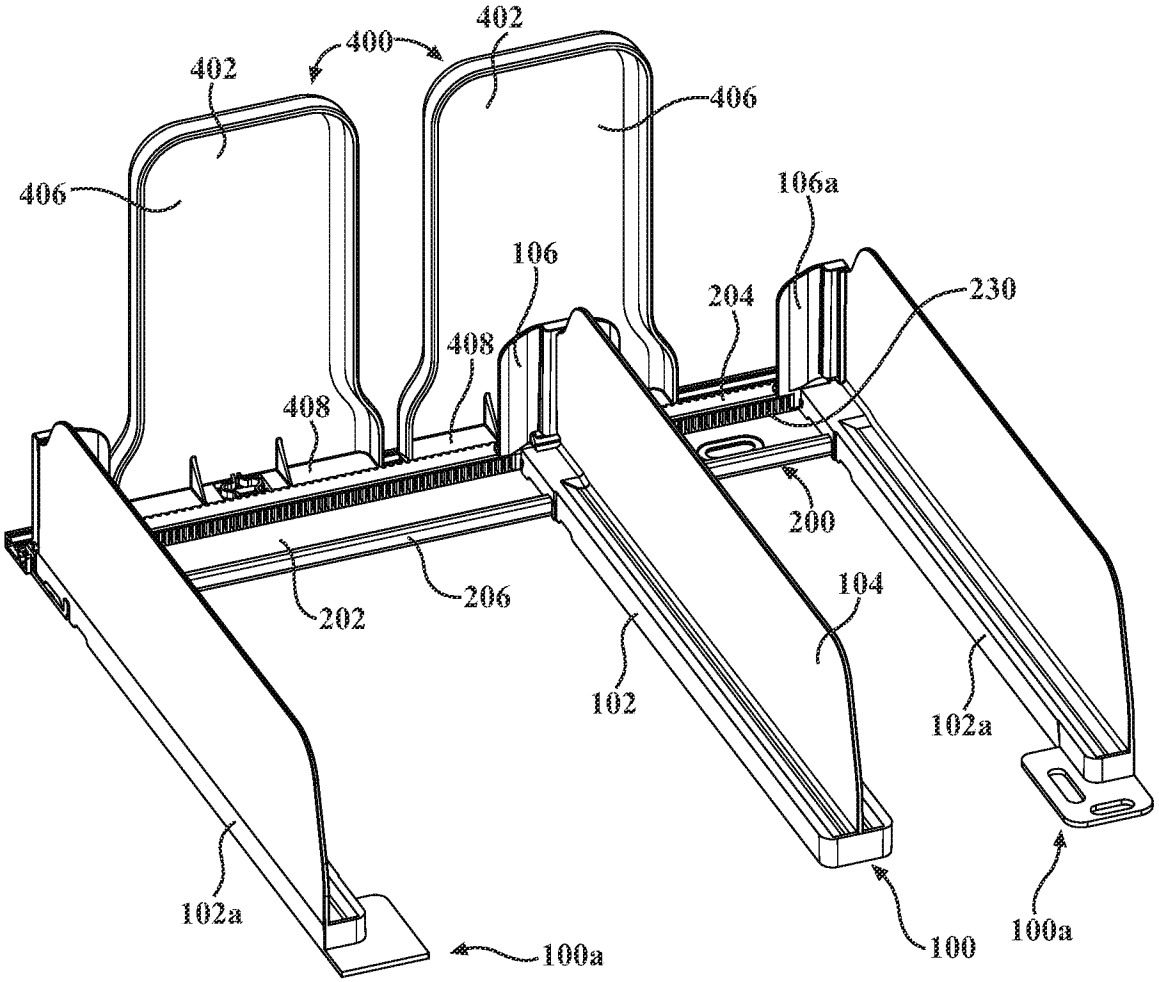
FIG. 3 is a rear perspective view of the merchandise security assemblies of FIG. 1.
Figure 4:
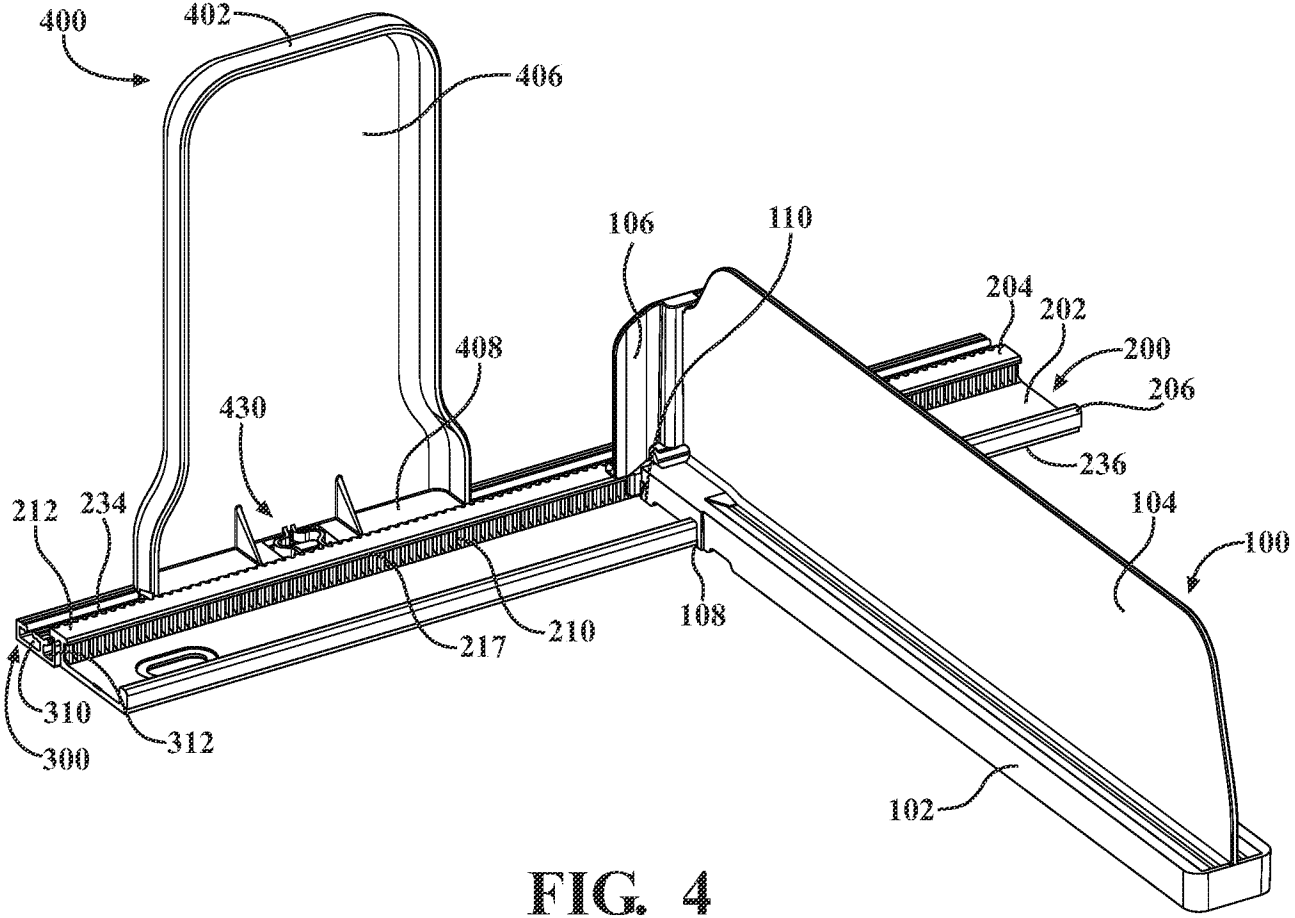
FIG. 4 is a rear perspective view of the merchandise security system of FIG. 1.
Figure 5:
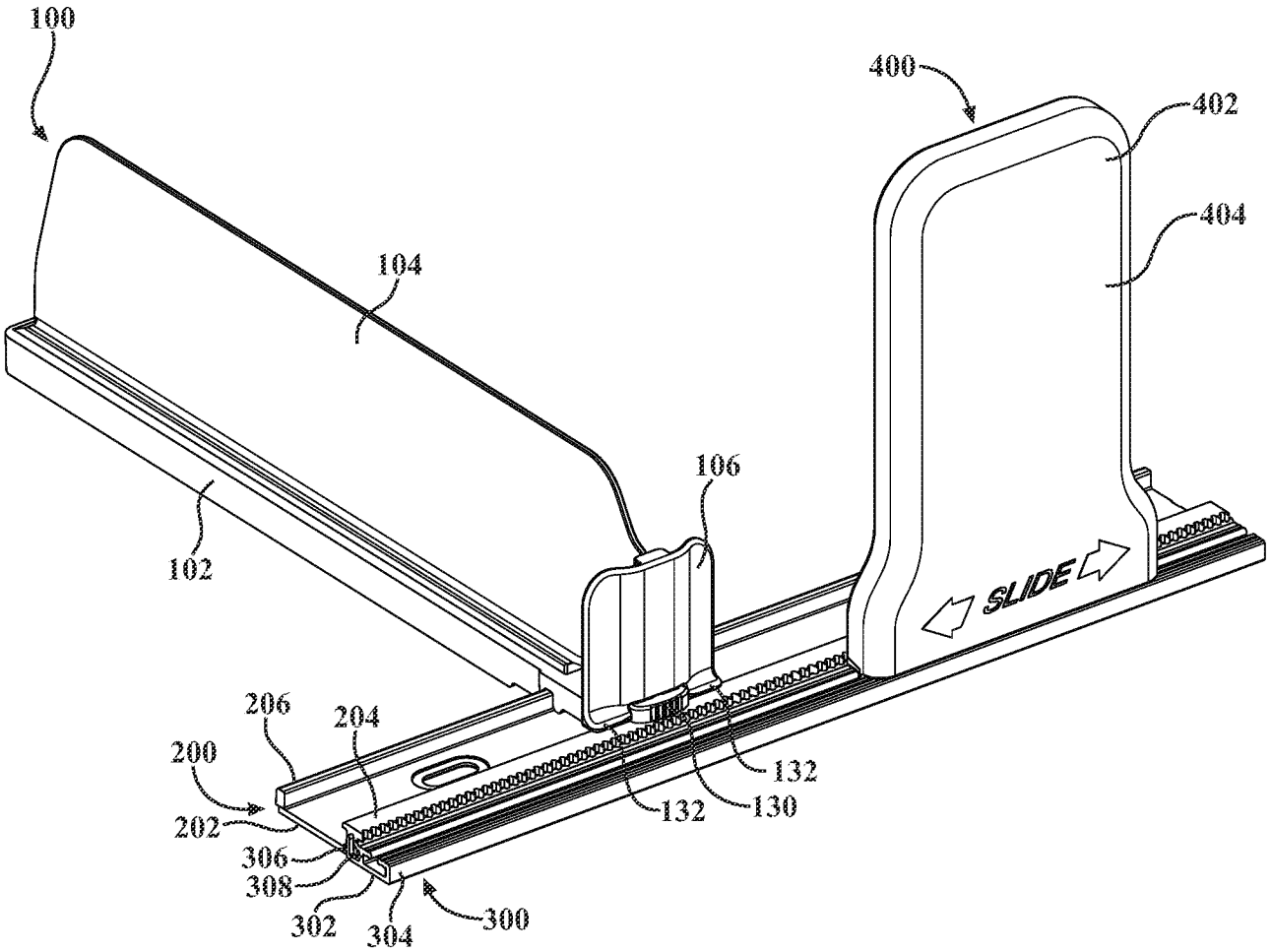
FIG. 5 is a front perspective view of the merchandise security system of FIG. 1.
Figure 13:
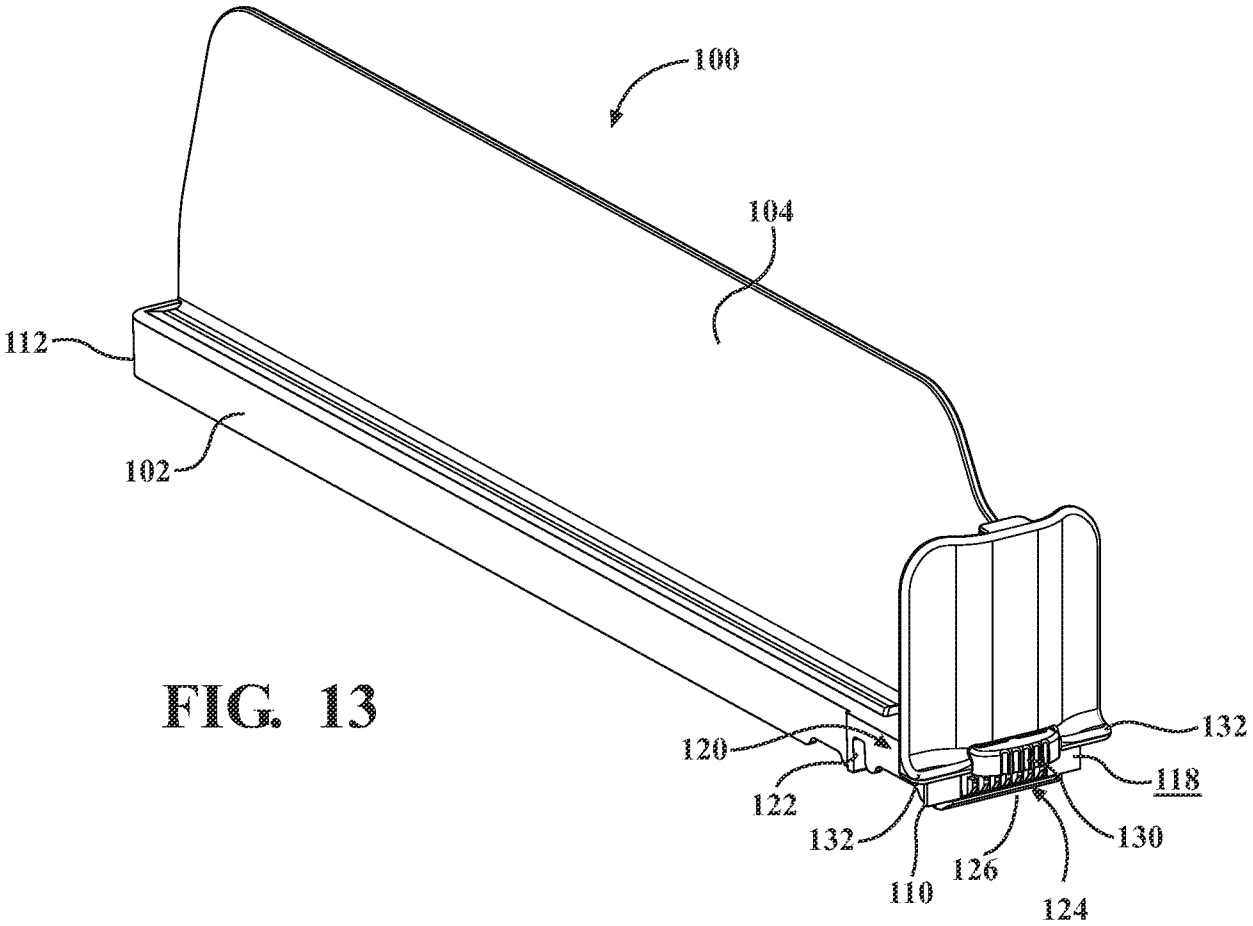
FIG. 13 is a front perspective view of a divider of the merchandise security system of FIG. 1.
Figure 14:
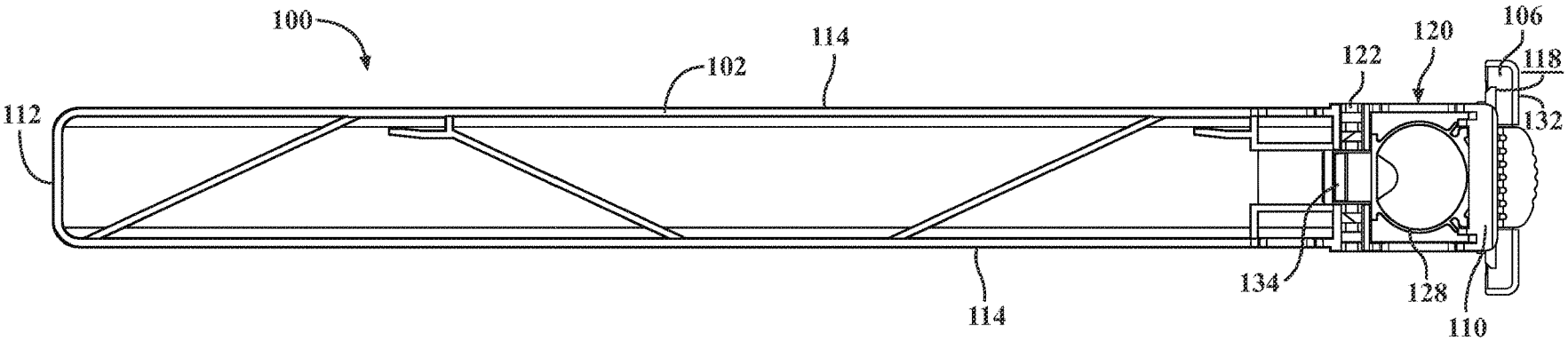
FIG. 14 is a bottom plan view of the divider of the merchandise security system of FIG. 1.

Referring to FIGS. 2-5 and 13-16, the base member 102, 102*a* of each divider 100, 100*a* extends from a first end 110 to a second end 112 along a longitudinal direction. As best shown in FIGS. 13 and 14, a width of each base member 102 is defined by a pair of parallel sidewalls 114 spaced apart from each other and extending from the first end 110 to the second end 112. The base member 102, 102*a* may further include a divider track 116 extending along the longitudinal direction adjacent to the divider wall 104, 104*a* between the first end 110 and the second end 112. The divider track 116 is configured to receive a pusher (not shown) that biases merchandise towards the first end 110 of the base member 102 (i.e., the front edge 16) of the shelf (12). As shown in FIG. 3, the central divider 100 is configured such that the divider wall 104 is centered between the sidewalls 114 of the base member 102 such the base member 102 extends in opposite directions from the divider wall 104 and includes a pair of pusher tracks 116 disposed on opposite sides of the divider wall 104. Conversely, the end dividers 100*a* include one sidewall 114 aligned with the divider wall 104 and include a single pusher track 116 extending along one side of the divider wall 104.

Each base member 102, 102*a* further includes a front bearing surface 118 disposed at the first end 110 and extending between the sidewalls 114. The bear surface 118 is configured to contact a corresponding bearing surface of the divider rail 200 and minimizes splaying of the divider 100 when lateral forces are applied, either during repositioning of the divider 100 or when merchandise is loaded into the product receiving area A. As shown, in FIGS. 13-16, the front bearing surfaces 118 may extend beyond the sidewalls 114 to maximize engagement between the first end 110 of the base member 102, 102*a* and the divider rail 200.

Figure 15:
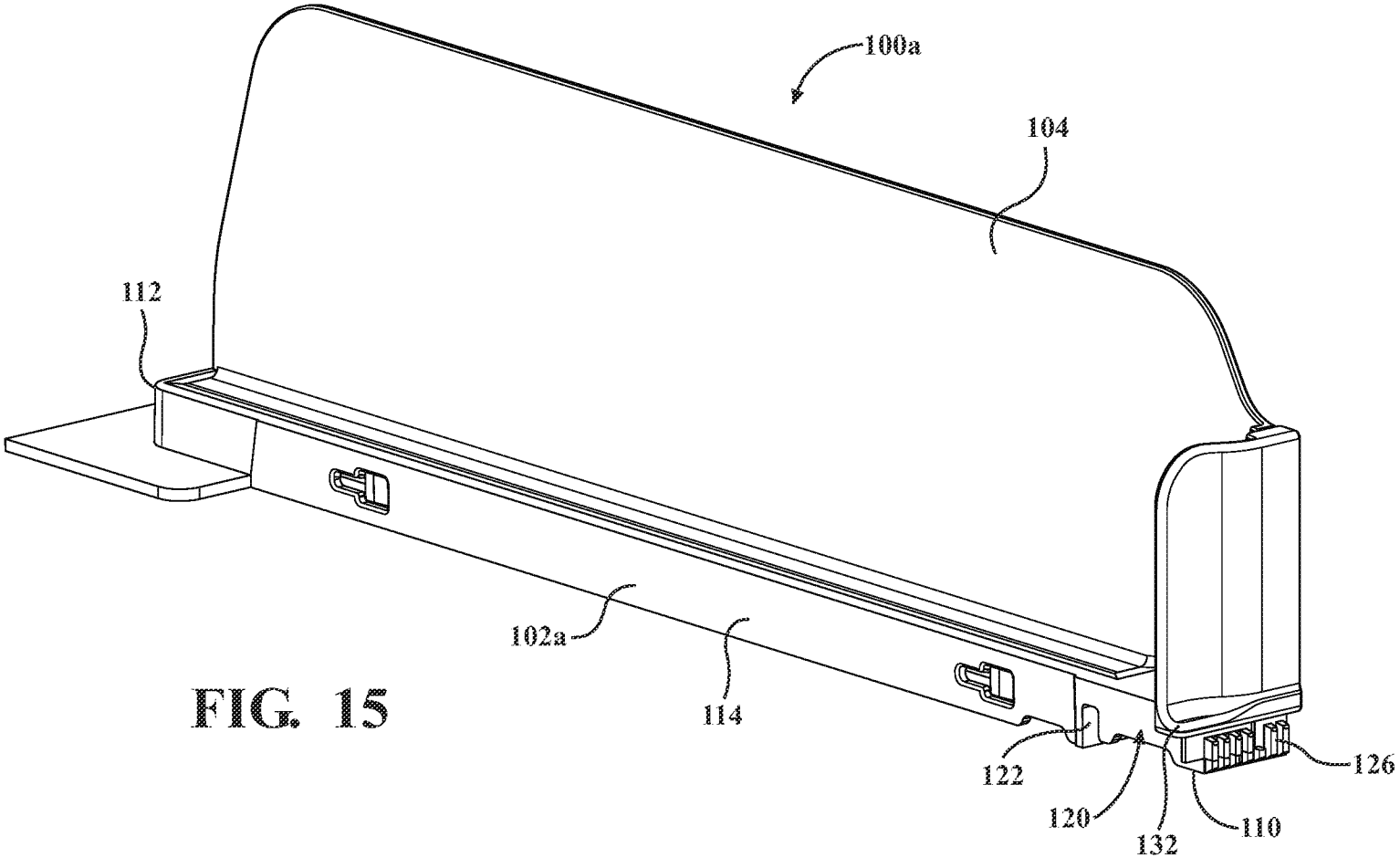
FIG. 15 is a front perspective view of another divider of the merchandise security system of FIG. 1.
Figure 16:
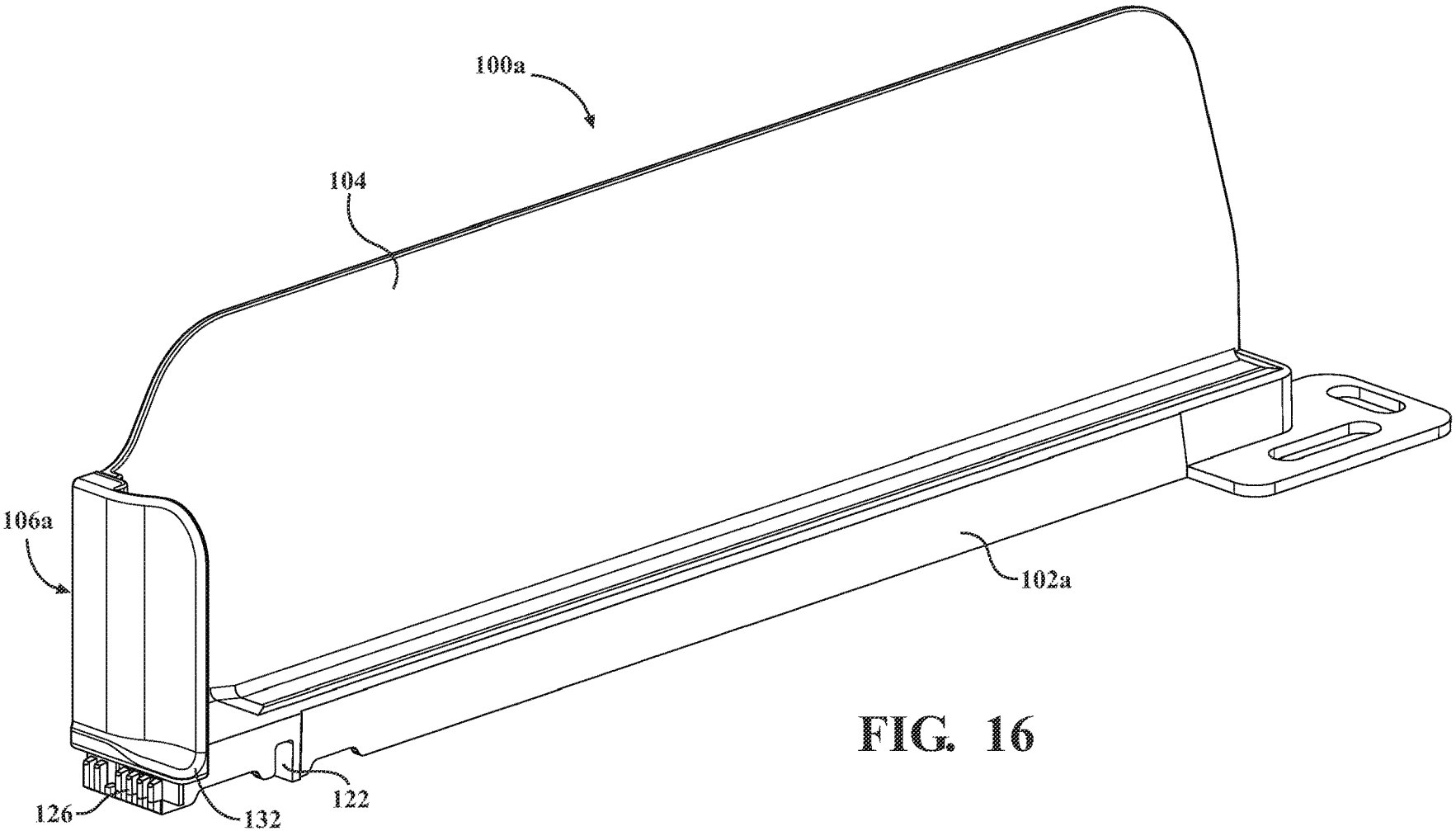
FIG. 16 is another front perspective view of the divider of FIG. 15.

With reference to FIGS. 13 and 14, the base member 102 of the central divider 100 includes an engagement system 120 disposed at the first end 110 and configured to selectively couple the base member 102 to the divider rail 200. As shown in FIG. 13, the engagement system 120 includes a slot 122 extending across the width of the base member 102 through the sidewalls that is configured to receive the divider rail 200. The engagement system 120 may further include an engagement mechanism 124 that is configured to selectively engage the divider rail 200. The engagement mechanism 124 includes a plurality of teeth 126 configured to engage corresponding teeth on the divider rail 200, as described in greater detail below. Referring to FIGS. 15 and 16, the end dividers 100*a* may include stationary engagement systems, wherein the position of the engagement mechanism 124 is fixed relative to the base member 102 such that the engagement mechanism 124 is disengaged from the divider rail 200 by lifting the second end 112 of the base member 102*a* from the shelf surface 14.

In some example, the engagement mechanism 124 is operable between a first, extended position (FIG. 14) and a second, retracted position. In the extended position, the teeth 126 project from the front bearing surface 118 of the base member 102 and are configured to engage corresponding teeth 230 of the divider rail 200 to prevent lateral movement of the central divider 100. In the retracted position, the teeth 126 are biased towards the second end 112 of the base member 102 (i.e., into the base member 102) such that the teeth 126 are flush with the front bearing surface 118, thereby disengaging the teeth 126 from the divider rail 200 to allow lateral movement of the central divider 100 along the divider rail 200 without removing the central divider 100 from the divider rail. Optionally, the engagement mechanism 124 may include an actuator 130 disposed at the first end 110 of the base member 102. The actuator 130 is coupled to the engagement mechanism 124 and/or the biasing element 128 and is configured to be engagement (e.g., pushed) by a user to move the engagement mechanism 124 from the extended position to the retracted position.

The end wall 106 includes a pair flanges 132 that are configured to rest on top of the divider rail 200 and act as vertical bearing surfaces along which the dividers 100, 100*a* may slide. The positioning of the dividers 100 relative to the divider rail 200 may be adjusted to fit the size of the specific merchandise. For example, if a small (i.e., thin) item of merchandise is selected, adjacent dividers 100 may be moved closer to one another to decrease a width of the product receiving area A. Conversely, if a large (i.e., wide) item of merchandise is selected, adjacent dividers 100 may be moved farther apart from one another to increase the width of the product receiving area A. The actuator 130 may include a series of ribs, bumps, etc., that enable a user to adequately grasp the end wall 106 and slide it in a horizontal direction along the divider rail 200, e.g., to fit smaller or larger items of merchandise.

The divider 100 may be formed of a known suitable plastic, such as a thermoplastic extrusion, or metal, such as an aluminum extrusion. In some implementations, the individual components of the divider 100 (i.e., the base member 102, the divider wall 104, and the end wall 106) may be formed as separate components and subsequently attached to one another. In other implementations, the individual components of the divider 100 (i.e., the base member 102, the divider wall 104, and the end wall 106) may be formed as a single, unitary structure.

Figure 6:
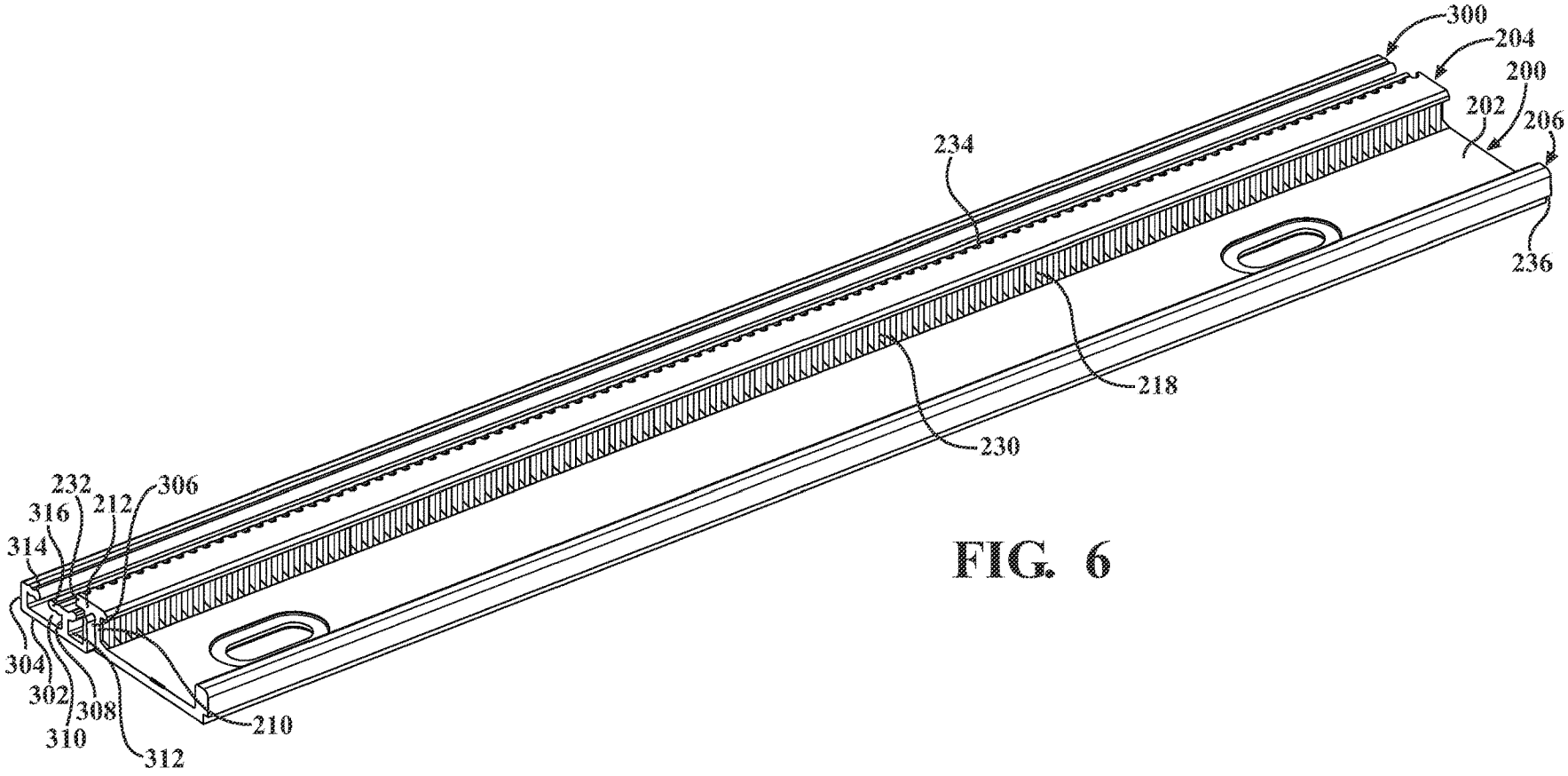
FIG. 6 is a rear perspective view of a divider rail and a tile rail of the merchandise security system of FIG. 1.
Figure 7:
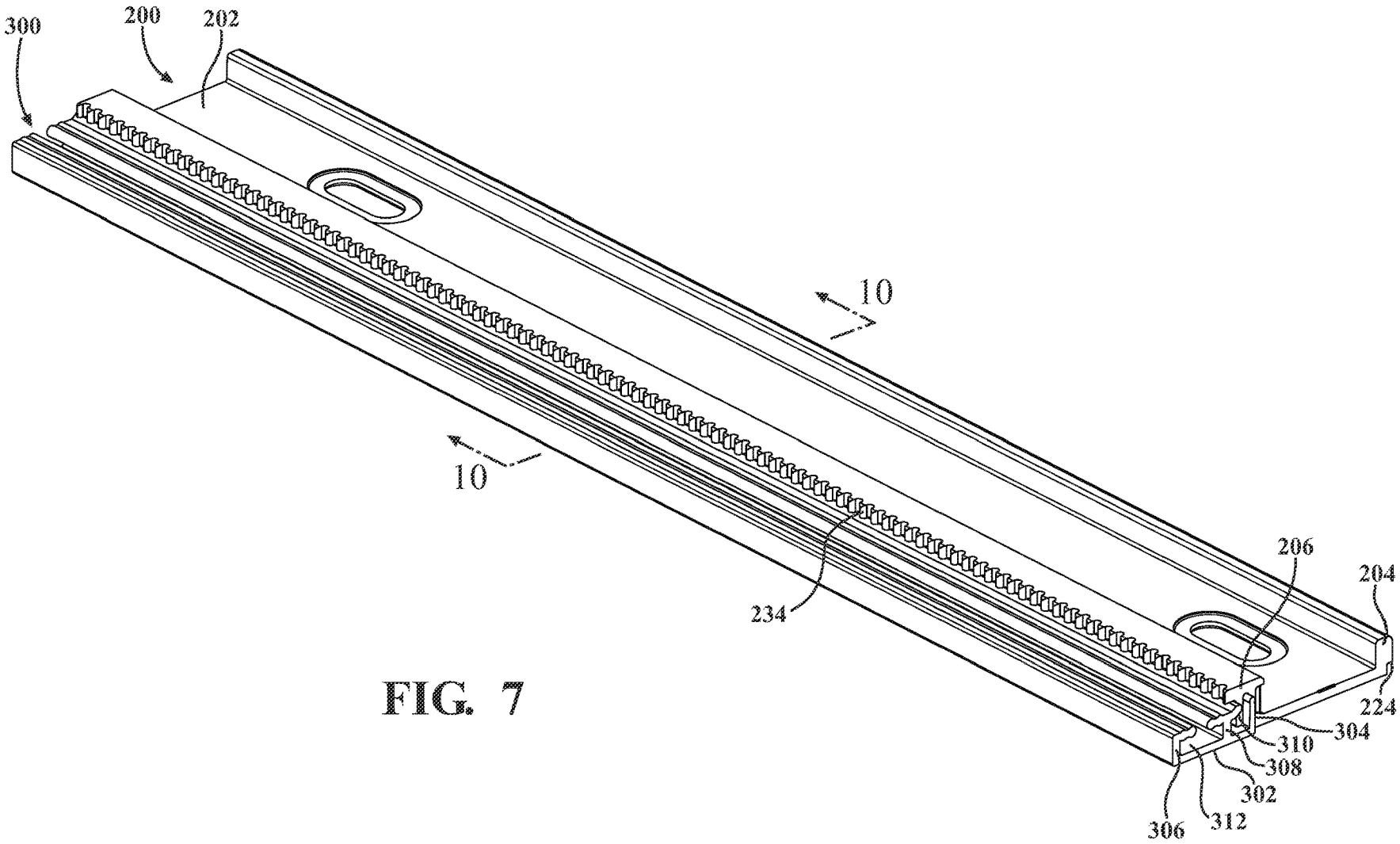
FIG. 7 is a front perspective view of the divider rail and the tile rail of the merchandise security system of FIG. 1.
Figure 8:
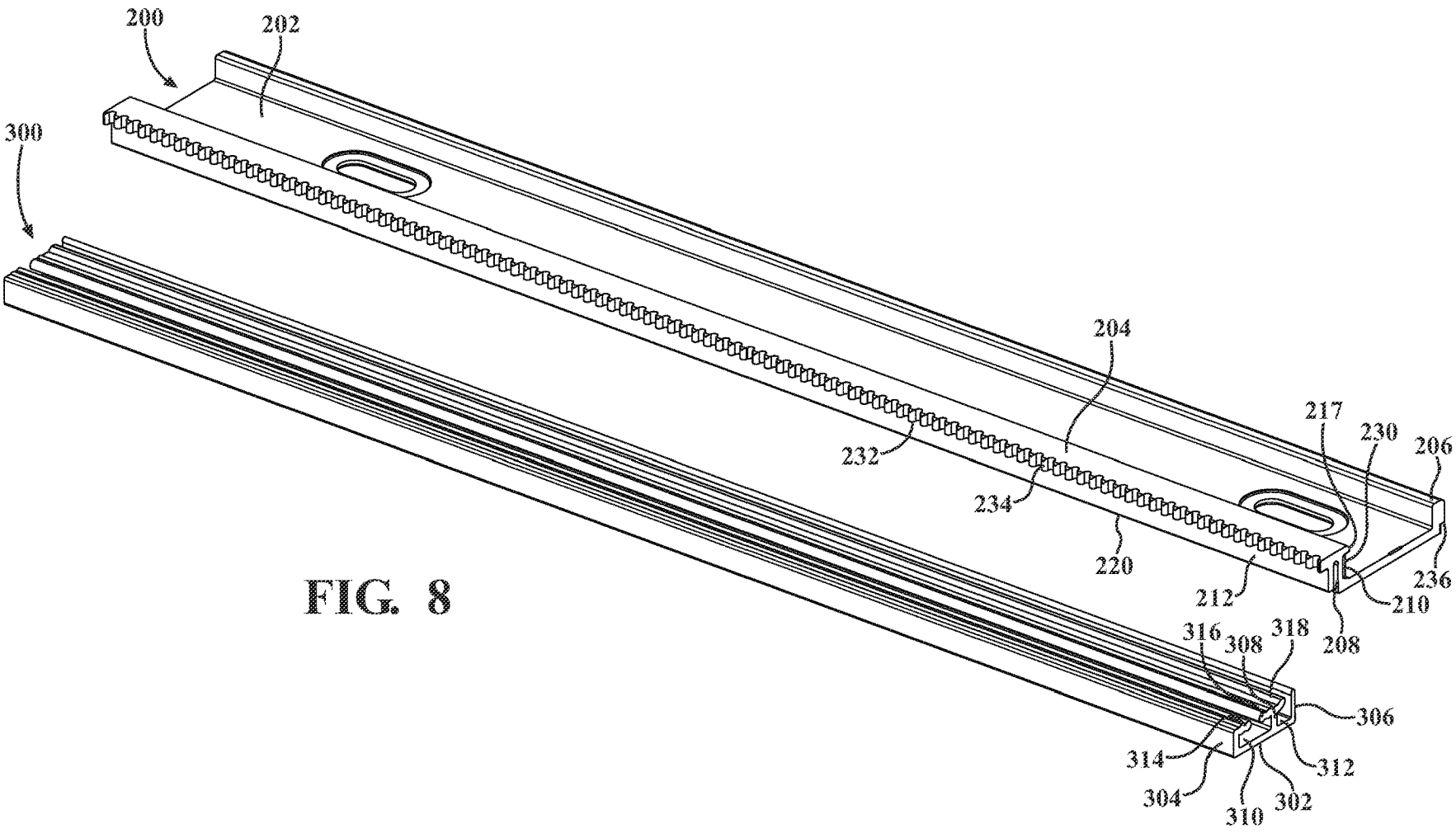
FIG. 8 is an exploded view of the divider rail and the tile rail of the merchandise security assembly of FIG. 1.

As best shown in FIGS. 6-8, the divider rail 200 includes a divider rail base 202, a front wall 204, and a rear wall 206. When the divider rail 200 is installed on the shelf 12, the front wall 204 is closer to the front edge 16 of the shelf 12 (i.e., the customer's vantage point) than the rear wall 206. The front wall 204 includes an accessory slot 208 that is configured to receive a portion of the tile rail 300 or other accessories and that divides the front wall into a first front wall portion 210 and a second front wall portion 212.

The front wall 204 of the divider rail 200 extends along a front edge of the divider rail base 202 and is spaced apart from the rear wall 206 by a channel 214. More specifically, the front wall 204 defines a first engagement surface 216 configured to extend along the lateral direction and the rear wall 206 defines a second engagement surface 218 extending parallel to and facing the first engagement surface 216 across the channel 214. When the assembly 10 is assembled, the engagement system 120 of the divider is received within the channel such that the engagement mechanism 124 interfaces with (i.e., selectively engages) the first engagement surface 216 and a rear surface of the engagement system 120 defined within the slot 122 interfaces with (e.g., selectively contacts) the second engagement surface 218.

The first engagement surface 216 is defined by the first portion 210 of the front wall 204. In the illustrated example, the first engagement surface 216 is recessed within the first portion 210 of the front wall 204 such that the first portion 210 of the front wall 204 defines a top lip 217 extending into the channel 214 and configured to capture the first end 110 of the divider between the top lip 217 and the base 202. In some examples, the first engagement surface 216 includes a plurality of teeth 230 disposed between the top lip 217 and the base 202 and facing the second engagement surface 218 (i.e., towards the channel 214). As discussed above, the plurality of teeth 230 are configured to be selectively engaged by the teeth 126 of the base member 102, 102*a* of the divider 100, 100*a*.

The selective engagement of the teeth 126, 230 allows the divider 100, 100*a* to be translated along the divider rail 200. In some implementations, the biasing element 128 allows the teeth 126 to move towards the second end 112 (i.e., toward and away from the customer's vantage point) such that, when the divider 100 is urged in a lateral or horizontal direction by a user along the divider rail 200, the teeth 126—via interaction with the biasing element 128—selectively disengage a first portion of the teeth 230 and, when the user ceases to exert a force upon the divider 100, the teeth 126—via interaction with the biasing element 128—selectively engage with a second portion of the teeth 230 to secure the divider 100 in the desired position along the divider rail 200.

Figure 9:
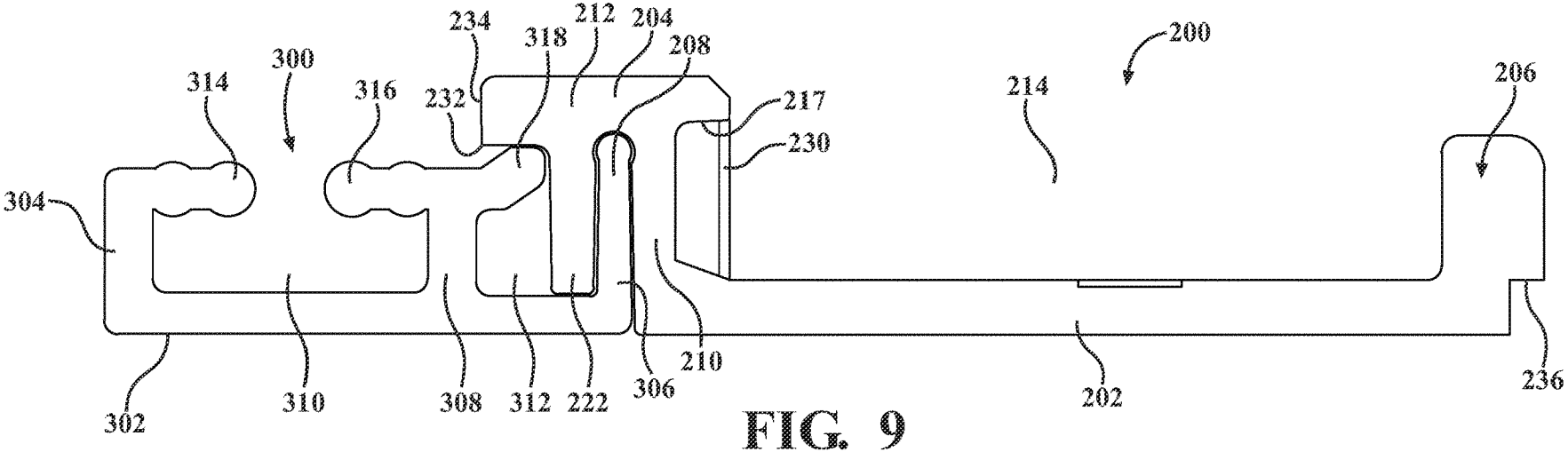
FIG. 9 is a side view of the divider rail and the tile rail of the merchandise security assembly of FIG. 1.
Figure 10:
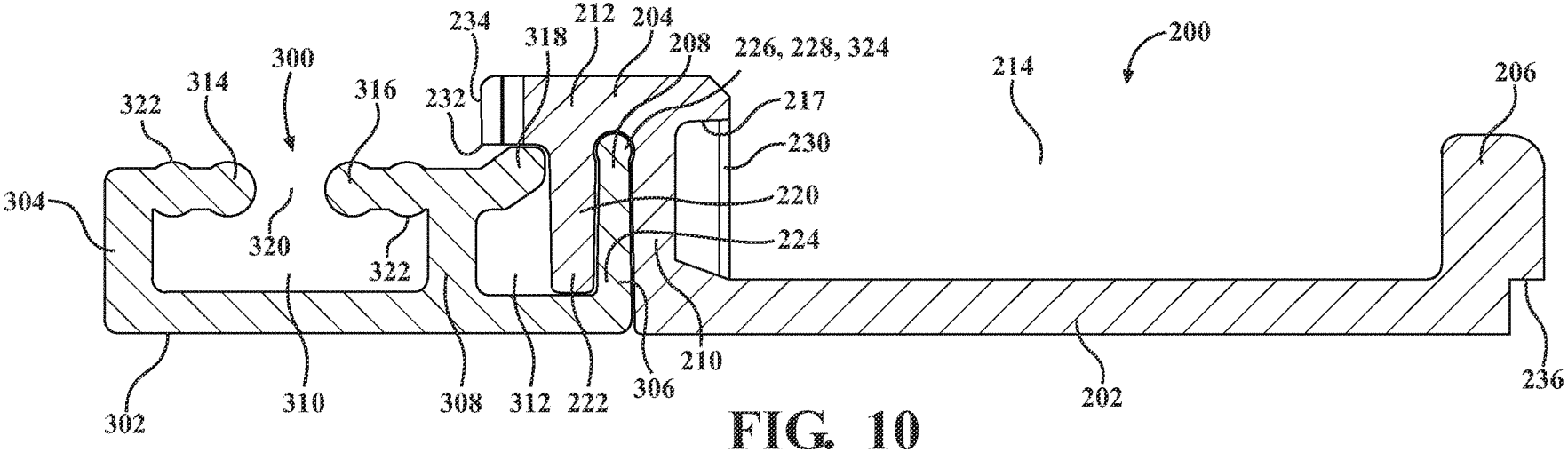
FIG. 10 is a cross-sectional view of the divider rail and the tile rail of the merchandise security system taken along line 10-10 of FIG. 7.

As best shown in FIGS. 9 and 10, the second portion 212 of the front wall 204 is attached to the first portion 210 along a top side of the front wall 204. The second portion 212 of the front wall 204 includes an elongate portion 220 adjacent to and spaced apart from the first portion 210 by the slot 208. Here, the elongate portion 220 extends from the top side to a distal end 222 configured to face the top surface 14 of the shelf 12. The distal end 222 of the elongate portion 220 is spaced apart from a bottom surface of the base 202 by a distance corresponding to a thickness of the tile rail such that a base 302 of the tile rail 300 can be received between the terminal end 226 and the top surface 14 of the shelf 12. As provided above, the slot 208 is defined by a gap or space between the first portion 210 and the second portion 212. A height of the slot 208 extends from an opening 224 formed in the bottom of the front wall 204 to a terminal end 226 disposed at the top of the front wall 204. A width of the slot 208 may taper along a direction from the opening 224 to the terminal end 226 and/or may define a socket 228 at the terminal end 226. Specifically, the socket 228 may have a size (e.g., width, diameter) that is larger than the width of the slot 208 to provide a snap fit function between the slot 208 and an accessory (e.g., the tile rail 300) that is inserted into the slot 208.

The second portion 212 of the front wall 204 includes front lip 232 projecting in an opposite direction from the front wall 204 than the rear lip. A bottom surface of the front lip 232 is configured to interface with a catch or flange 318 of the tile rail 300 when the assembly 10 is assembled. Optionally, front surface of the front lip 232 may include a plurality of teeth 234 extending in an opposite direction from the first portion 210 (i.e., towards facing the customer's vantage point). While the teeth 234 are shown as being formed on the front surface of the front lip 232, the teeth 234 may also be formed on a top side of the front wall 204 or on a bottom side of the front lip 232.

The rear wall 206 is configured to engage the slot 122 of the base member 102 of the divider 100. In some implementations, the rear wall 206 includes a rear wall lip 236 formed on an opposite side of the rear wall 206 than the second engagement surface 218 and a portion of the base member 102 within the slot 122 includes a catch 134 or other engagement member configured to engage the rear wall lip 236. The divider rail 200 may be formed of a known suitable plastic, such as a thermoplastic extrusion, or metal, such as an aluminum extrusion.

With continued reference to FIGS. 6-10, the tile rail 300 includes a base 302, a front wall 304, a rear wall 306, and a middle wall 308 between the front wall 304 and the rear wall 306. The front wall 304 and the middle wall 308 are spaced apart from each other to define a tile track 310, and the middle wall 308 and the rear wall 306 are spaced apart from each other to define a rear slot 312 extending parallel to the tile track 310. The front wall 304 extends from a first end attached to the base 302 to a distal end that includes a first top flange 314 extending to a terminal end facing the middle wall 308 tile track 310. Similarly, the middle wall 308 extends from a first end attached to the base 302 to a distal end that includes a second top flange 316 extending to a terminal end facing the front wall 304. As shown, the terminal end of the second top flange 316 is tile track 310 spaced apart from the terminal end of the first top flange 314 to define an opening 320 into the tile track 310 having a width that is less than a width of the tile track 310. Thus, the top flanges 314, 316 cooperate to define a T-slot extending along a front end of the tile rail. Optionally, each of the flanges 314, 316 may include bearing elements 322.

The middle wall 308 further includes a rearwardly extending flange or catch 318 configured to engage a portion of the divider rail 200. The catch 318 extends from the terminal end of the middle wall 308 in an opposite direction than the second top flange such that a terminal end of the catch 318 is configured to interface with the front lip 232 of the divider rail 200 when the assembly 10 is assembled.

The rear wall 306 extends from the base 302 on an opposite side of the middle wall 308 from the front wall 304 and is spaced apart from the middle wall 308 by the rear slot 312. The rear wall 306 is configured to be received through the opening 224 of the slot 208 such that a terminal end 324 of the rear wall 306 is received within the socket 228 of the slot 208. Accordingly, the terminal end 324 may have a bulbous profile configured to snap into the socket 228 of the slot 208 to prevent unintended disengagement of the rear wall 306 from the slot 208.

The tile rail 300 is configured to engage with the divider rail 200. As best seen in FIGS. 9 and 10, the rear wall 306 of the tile rail 300 engages with the slot 208 of the divider rail 200, and the catch 318 of the tile rail 300 engages with the front lip 232 of the divider rail 200. In such a position, the elongate portion 220 extends into the rear slot 312, and the rear wall 306 is disposed between the elongate portion 220 and the first portion 210 of the front wall 204. In this way, the tile rail 300 may be secured to the divider rail 200 without the use of any fasteners, and the tile rail 300 may be selectively removed from the divider rail 200. In other implementations, the divider rail 200 may be secured to the tile rail 300 in any suitable manner, including welding, adhesive, fasteners, etc. The tile rail 300 may be formed of a known suitable plastic, such as a thermoplastic extrusion, or metal, such as an aluminum extrusion.

Referring to FIGS. 1-5, 11, and 12, each of the tiles 400 includes a base 402 and a front wall 404 extending from the base 402. In some implementations, the base 402 and the front wall 404 tile 400 may be formed from a single body, or may be formed from multiple body portions secured to one another. The front wall 404 generally includes a front surface that faces toward the customer's vantage point and a rear surface formed on an opposite side of the front wall 404 from the front surface, which generally faces away from the customer's vantage point. The base 402 faces toward the shelf 12 when installed on the shelf 12. The tile can be made from a suitable known plastic material, such as by injection molding. In one embodiment, the tile or blocking member is at least partially transparent so that items of merchandise held on a shelf behind it remain visible. The front wall 404 may include text that is printed, engraved, or protruding. In some implementations, the text may read "slide" as shown in the figures.

Figure 11:
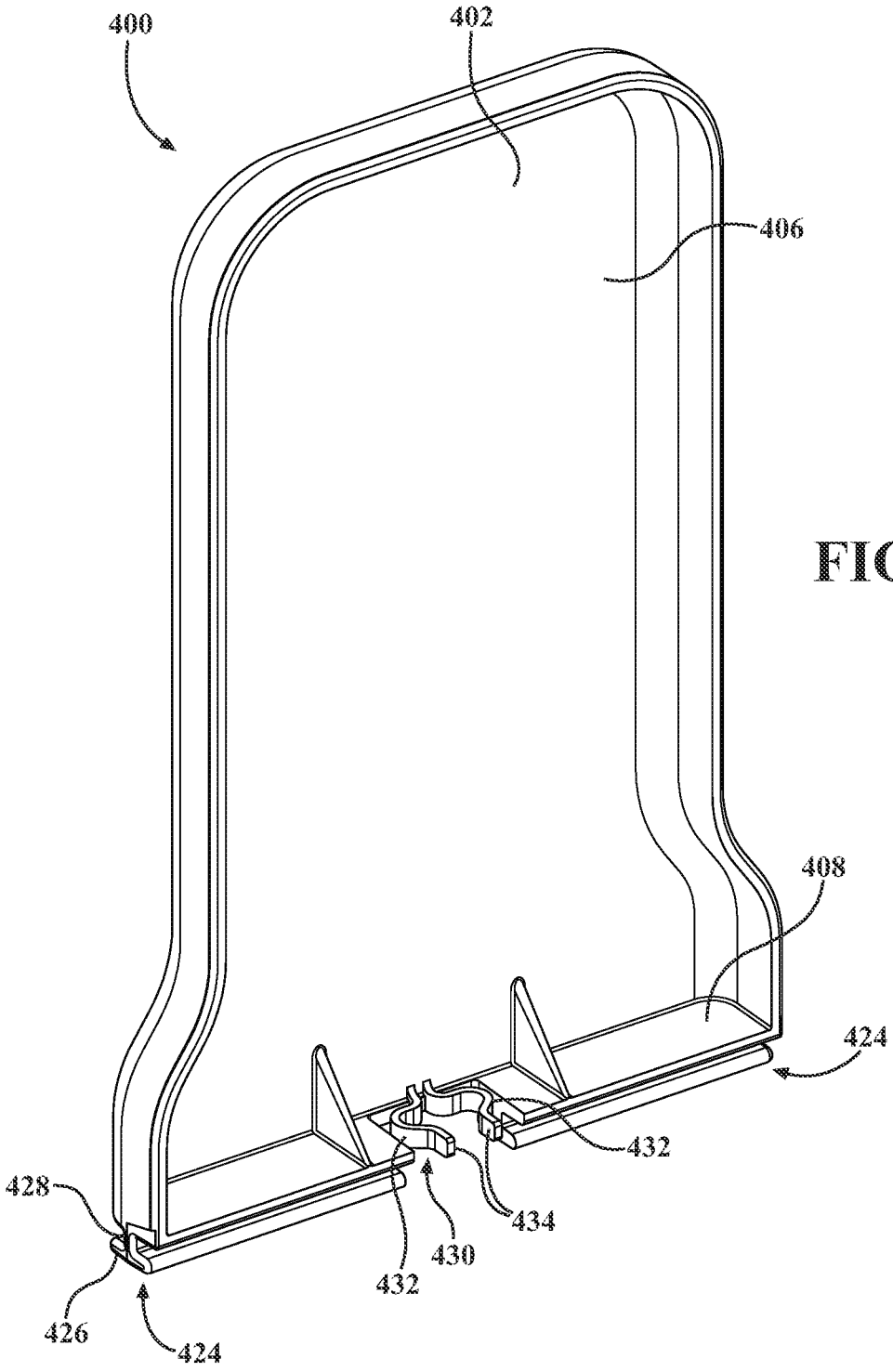
FIG. 11 is a rear perspective view of a tile of the merchandise security system of FIG. 1.
Figure 12:
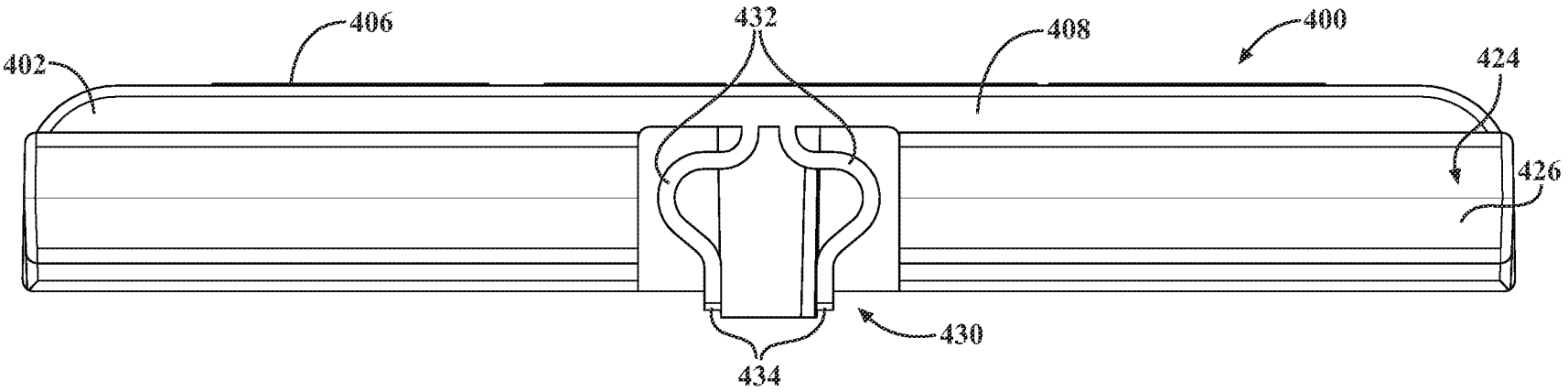
FIG. 12 is a bottom plan view of the tile of the merchandise security system of FIG. 1.

Referring to FIGS. 11 and 12, the base 402 includes a bearing rail 424 including a planar portion 426 and a neck 428 connecting the planar portion 426 to the base 402. The bearing rail 424 may be generally shaped like a T corresponding to the size shape of the tile track 310, but other shapes are likewise contemplated, including an L shape, a J shape, or any other suitable shape. The bearing rail 424 is configured to engage the tile track 310 of the tile rail 300, with the planar portion 426 disposed between the front wall 304 and the middle wall 308, and the neck 428 being disposed between the terminal ends of the flanges 314, 316. The flanges 314, 316 extending over the tile track 310 and the T-shape of the bearing rail 424 results in the tile 400 being selectively secured to the tile rail 300 in the tile track 310. As shown, the bearing elements 322 of the flanges 314, 316 may have a bulbous profile (i.e., two bulbous shapes) that are configured to reduce sliding friction between the flanges 314, 316 and the bearing rail 424.

The base 402 includes one or more fingers 430 extending away from a rear surface of the front wall 404. In the illustrated example, the one or more fingers 430 includes a pair of fingers 430 each configured to engage corresponding ones of the teeth 234 of the divider rail 200. Each of the pair of fingers 430 include a flexure 432 and an engagement portion 434. The flexure 432 enables the finger 430 to flex resiliently and the engagement portion 434 is configured to engage the teeth 234 of the front wall 204 of the divider rail 200. As the tile 400 is slid along the tile rail 300 (e.g., by a user), the engagement portions 434 of the fingers 430 engaging the teeth 234 may provide an audible feedback (e.g., clicking noise) to indicate that the tile 400 is successfully moving along the tile rail 300.

In operation, the assembly 10 may be installed on the top surface 14 of a shelf 12 at a place of commerce. The dividers 100 may be slid along the divider rail 200 via a user exerting a force on the end walls 106 (i.e., the actuator 130) so that the teeth 126 selectively disengage and engage, via interaction with the biasing element 128, with the corresponding teeth 230 of the divider rail 200. The dividers 100 are moved along the divider rail 200 to fit the desired size of items of merchandise. At the desired spacing, the items of merchandise are placed between adjacent dividers and behind the end wall 106. The tile 400 may then be slid along the tile rail 300 via the fingers 430 selectively disengaging and engaging the front teeth 234 of the divider rail 200 until the tile 400 is disposed between the adjacent dividers 100 to block the items of merchandise. At this point, a thief is unable to sweep the shelf, but a proper customer is still able to obtain the items of merchandise by sliding the tile 400 along the tile rail 300 until the items of merchandise are accessible.

The modular structure of the assembly 10 allows shelves 12 to be fitted with adjustable dividers 100 with and without the tiles 400. For example, in some configurations, user (e.g., store clerk) may configure the shelf 12 without the tiles 400 where it is desirable for all of the merchandise on the shelf to be simultaneously accessible (e.g., items that are less likely to be "swept" off of the shelf). Here, the user may provide the assembly 10 with the divider rail 200 and the desired number of dividers 100, 100*a*. In other situations, the user may wish to include the added security provided by the tiles 400. Here, the user can snap the tile rail 300 into the accessory slot 208 of the divider rail 200 to provide the assembly 10 with the tile track 310. The user can then include any number of the tiles 400 at the front of the assembly 10 to prevent sweeping.

In some implementations, the accessory slot 208 may be utilized for other accessories. For example, a user may attach a variety of marketing materials, sale materials, merchandise descriptions, etc.

With particular reference to FIGS. 17-29, another example of a merchandise security assembly 10*a* is provided and includes an adjustable tile 400*a*. In view of the substantial similarity in structure and function of the components associated with the assembly 10 with respect to the assembly 10*a*, like reference numerals are used hereinafter and in the drawings to identify like components while like reference numerals containing letter extensions are used to identify those components that have been modified.

Referring to FIGS. 17 and 18, the assembly 10*a* may include a plurality of the adjustable tiles 400*a* slidably coupled to the tile rail 300 in a similar fashion as previously described with respect to the tiles 400. The assembly 10*a* may include the adjustable tiles 400*a* slidably mounted to a tile rail 300 disposed on the top surface 14 of the shelf 12, as previously described.

Referring now to FIGS. 19-27, a first example of the adjustable tile 400*a* includes an adjustable base 402*a* and an adjustable front wall 404*a*. Generally, the adjustable base 402*a* is operable to transition the adjustable tile 400*a* along the longitudinal direction between a retracted configuration (FIG. 19) and an extended configuration (FIG. 20). Here, the retracted configuration (FIG. 20) refers to a configuration where the front wall 404*a* is spaced a first distance D1 from the front wall 304 of the tile rail 300, while the extended configuration (FIG. 20) refers to a configuration where the front wall 404*a* is spaced outwardly from the front wall 304 of the tile rail 300 by a greater distance D2 than the first distance D1. The front wall 404*a* may be moved from the retracted configuration to the extended configuration to accommodate products or shelves 12 having different dimensions. For example, the front wall 404*a* may be moved to the extended configuration to accommodate shelves 12 having a front edge 16 that is spaced farther away from the front wall 304 of the tile rail 300 to ensure that that front wall 404*a* of the tile 400*a* is aligned with the front edge 16 of the shelf 12. This may increase security by minimizing gaps or spaces between the tiles 400*a* and the front edges 16 of upper and lower shelves 12. Additionally, where the front wall 404*a* of the tile includes product information or advertising, adjusting the configuration of the base 402*a* ensures that the front wall 404*a* is displayed at the front edge 16 of the shelf 12.

The adjustable tile 400*a* further includes the adjustable front wall 404*a*, which is operable to be reconfigured between a shortened configuration (FIG. 19) and a lengthened configuration (FIG. 20). Here, the shortened configuration refers to a configuration where the front wall 404*a* has a first height H1, while the lengthened configuration refers to a configuration where the front wall 404*a* has a second height H2 that is greater than the first height H2. The front wall 404*a* may be moved between the shortened configuration and the lengthened configuration to accommodate different vertical spacing between respective upper and lower shelves. For example, where the tile 400*a* is installed on a shelf 12 having a relatively large space between upper and lower shelves, the tile 400*a* may be transitioned to the lengthened configuration to minimize the gap between a distal end (e.g., the top) of the front wall 404*a* and the adjacent shelf 12.

In FIG. 19, the adjustable tile 400*a* is shown with the base 402*a* in the retracted state and the front wall 404*a* in the shortened state, while FIG. 20 shows the adjustable tile 400*a* with the base 402*a* in the extended state and the front wall 404*a* in the lengthened state. However, the adjustable tile 400*a* may be configured in a retracted-lengthened configuration, in an extended-shortened configuration, or in intermediate configurations.

Referring to FIGS. 19-27, the adjustable tile 400*a* includes a carriage 406, a lower wall 408 coupled to the carriage 406, and an upper wall 410 coupled to the lower wall 408. Generally, the carriage 406 and the lower wall 408 cooperate to define the adjustable base 402*a* of the adjustable tile 400*a*, while the upper wall 410 and the lower wall 408 cooperate to define the adjustable front wall 404*a* of the tile 400*a*.

As best shown in FIGS. 23-25, the carriage 406 includes a bottom wall 420 and a sidewall 422 extending from a perimeter the bottom wall 420. The bottom wall 420 defines a portion of the base 402*a* including the bearing rail 424 and the fingers 430, as previously described. Thus, the bottom wall 420 of the carriage 406 includes the portion of the base 402*a* configured to interface with the tile rail 300 to facilitate lateral movement of the adjustable tile 400*a* along the shelf 12. As shown, the bearing rail 424 extends from a bottom side of the bottom wall 420 while the sidewall 422 extends in an opposite direction from a top side of the bottom wall 420. The fingers 430 are disposed within a recess formed in the bottom wall 420 and project rearwardly such that the engagement portion 434 of each finger 430 protrudes from a rear edge of the bottom wall 420 to engage the front teeth 234 of the divider rail 200.

The sidewall 422 of the carriage 406 extends from a top side of the bottom wall 420. In the illustrated example the sidewall 422 includes a front sidewall portion 422*a* and a pair of end sidewall wall portions 422*b* extending from sides of the bottom wall 420. Accordingly, the sidewall 422 includes three sides such that a rear side of the carriage 406 is open and accessible. The sidewall 422 may be configured to cooperate with the lower wall 408 of the tile 400*a* to facilitate movement of the base 402*a* between the retracted state and the extended state. In the illustrated example, the sidewall 422 extends orthogonally from the top side of the bottom wall 420.

Referring to FIG. 23, the carriage 406 includes a pair of openings or receivers 436 formed through the front of the carriage 406. In the illustrated example, each of the receivers 436 includes an upper portion formed through the front sidewall portion 422*a* and a lower portion extending partially into the bottom wall 420 (i.e., a notch in the bottom wall 420). As discussed in greater detail below, each receiver 436 is configured to receive and guide a corresponding component (e.g. a tongue) of the lower wall 408 to provide a linear bearing interface between the carriage 406 and the lower wall 408. Each receiver 436 may further include a support lip 438 extending from the front sidewall portion 422*a* above the upper portion of the receiver 436. The support lip 438 includes a bottom surface facing and parallel to a top side of the bottom wall 420. As discussed in great detail below, the bottom surface of the support lip 438 provides a support and bearing surface for supporting and sliding the lower wall 408 in and out of the carriage 406.

With continued reference to FIGS. 23-25, the sidewall 422 of the carriage 406 further defines a pair of longitudinal adjustment elements 440 configured to secure a relative position between the carriage 406 and the front wall 408 between the retracted configuration and the extended configuration. As shown, the adjustment elements 440 of the present example include a plurality of adjustment teeth 442 arranged in series along an outer surface of each end sidewall portion 422*b*. Specifically, the adjustment teeth 442 are arranged in series along the longitudinal direction (i.e., from front to back). Here, the adjustment teeth 442 are unidirectional and include a beveled front tooth surface 442*a* facing the front sidewall portion 422*a* and a rear tooth surface 442*b* facing away from the front sidewall portion 422*a*. As discussed below, the front tooth surface 442*a* is formed at an oblique angle relative to the end sidewall portion 422*a* to allow a corresponding adjustment element of the front wall 408 to pass over each adjustment tooth 442 when the front wall 408 is moved toward the retracted configuration. Conversely, the rear tooth surface 442*b* may be formed at an orthogonal angle or as an undercut relative to the end sidewall portion 422*b* such that the rear tooth surface 442*b* provides a catch for a locking element 458 of the front wall 408 and prevents movement of the front wall 408 towards the extended portion.

Optionally, the sidewall 422 of the carriage 406 may include a pair of wings 444 spaced outwardly from and extending parallel to each of the end sidewall portions 422*b*. The wings 444. Each wing 444 is configured to conceal the adjustment elements 440 formed along the ends of the carriage 406. When present, each wing 444 may include an opening 446 formed in the front sidewall portion 422*a*, which is configured to receive the corresponding adjustment element of the front wall 408 when the tile 400*a* is assembled.

With continued reference to FIGS. 21-27, the lower wall 408 extends along the vertical direction from a bottom end 450 to an upper end 452. Generally, the bottom end 450 is configured to attach to or interface with the carriage 406 to form the base 402*a* and the upper end 452 is configured to attach to or interface with the upper wall 410 to form the front wall 404*a*. The lower wall 408 further includes front panel 453 extending from the bottom end 450 to the upper end 452 and a pair of sidewalls 454 each extending from the bottom end 450 to the upper end 452 on opposite sides of the front panel 453.

As best shown in FIG. 23, the lower wall 408 includes a pair of tongues 456 extending in a rearward direction from the bottom end 450. In the illustrated example, each tongue 456 is formed as a generally flat member having a thickness $T_{456}$ and width $W_{456}$ configured to slidingly insert into a corresponding one of the receivers 436 of the carriage 406. A length of the tongue 456 is configured such that the tongue 456 remains engaged with the receiver 436 when the lower wall 408 is moved between the retracted configuration (FIG. 25) and the extended configuration (FIG. 24). Specifically, a top surface of the tongue 456 contacts the bottom surface of the support lip 438 to provide a sliding bearing interface between the lower wall 408 and the carriage 406. Optionally, distal ends (i.e., ends facing away from the lower wall 408) of each tongue 456 may include a tapered width, such as chamfered or radius corners, to facilitate insertion of the tongues 456 into the receivers 436.

Referring still to FIG. 23, the bottom end 450 of the lower wall 408 further includes a pair of locking elements 458 configured to engage the longitudinal adjustment elements 440 of the carriage 406 to secure the configuration of the base 402*a* (e.g., extended, retracted). In the illustrated example, the locking elements 458 are embodied as a pair of prongs 458 extending from the bottom end 450 of the lower wall 408 adjacent to opposite sidewalls 454 of the lower wall 408. Here, each prong 458 includes a resilient member 460 extending from the bottom end 450 to a distal end including a locking feature 462 configured to engage a corresponding one of the adjustment elements 440 of the carriage 406. The locking feature 462 may include one or more locking teeth 462 each including a front tooth surface 462*a* configured to lock against the rear tooth surface 442*b* of one of the adjustment teeth 442 and a biased or beveled rear tooth surface 462*b* configured to slide over the beveled front surface 442*a* of the adjustment teeth 442 as the front wall 408 is moved to the retracted position.

In use, the tile 400*a* is initially assembled by aligning the tongues 456 of the lower wall 408 with the receivers 436 of the carriage 406. The tongues 456 are then inserted into the receivers 436 and the locking elements 458 are simultaneously received through the openings 446 in the front sidewall portion 422*a* of the carriage 406 such that the locking elements 458 of the lower wall 408 engage respective ones of the longitudinal adjustment elements 440 of the carriage 406. Specifically, as the lower wall 408 is moved to the retracted configuration, the beveled rear tooth surface 462*b* of each locking feature 462 engages the beveled front surface 442*a* of one of the adjustment teeth 442 and the distal end of the locking element 458 is biased away from the end sidewall portion 422*b* to pass over the adjustment tooth 442. Once a desired configuration is obtained, the front wall 408 is prevented from moving to the extended configuration by locking engagement of the rear tooth surface 442*b* of one of the adjustment teeth 442 and the front tooth surface 462*a* of one of the locking teeth 462. To move the lower wall 408 toward the extended configuration, the distal ends of the locking elements 458 are manually biased outwardly such that the adjustment teeth 442 can move past the locking teeth 462.

As best shown in FIGS. 24 and 25, the lower wall 408 includes a pair of guide slots 466 formed on opposite sides of the lower wall 408. Here, each of the guide slots 466 is formed in one of the sidewalls 454 and extends along the vertical direction from an open first end 468 at the upper end 452 to a terminal second end 470 between the upper end 452 and the bottom end 450. As described in greater detail below, each guide slot 466 is generally configured to slidingly receive a corresponding portion of the upper wall 410 to facilitate movement of the tile 400*a* between the shortened configuration (FIG. 27) and the lengthened configuration (FIG. 26).

Optionally, the lower wall 408 may further include a pair of gripping features 472 formed in each of the sidewalls 454. In the illustrated example, each gripping feature 472 is formed as an arcuate recess in one of the sidewalls 454 between the terminal end 470 of the guide slot 466 and the bottom end 450 of the lower wall 408. The gripping features 472 provide a structure for a user to grasp the tile 400*a* to move the tile along the lateral direction along the tile rail 300. For example, the user may apply a lateral force along one of the gripping features 472 to move the tile 400*a* in the direction of the lateral force along the tile rail 300.

With reference to FIGS. 21-23, 26, and 27, the upper wall 410 is generally configured to be slidably received by the guide slots 466 of the lower wall 408 to move the front wall 404*a* between the lengthened configuration (FIG. 26) and the shortened configuration (27). The upper wall 410 generally extends from a lower end 476 to a top end 478, which forms a distal end of the front wall 404*a* of the tile 400*a*. A pair of upper sidewalls 480 extend from the lower end 476 to the top end 478 on opposite sides of the upper wall 410 and are configured to cooperate (e.g., mate) with the lower sidewalls 454 of the lower wall 408 to provide a sliding interface between the upper wall 410 and the lower wall 408. As shown, each of the sidewalls 480 of the upper wall 410 defines a guide rail 482 configured to be received within the guide slot 466 of the lower wall 408. In the illustrated example, the guide rail 482 is formed as an elongate member extending inwardly (i.e., towards the center of the upper wall 410) from the sidewall 480 and is separated from a front panel 483 of the upper wall 410 by a gap or space.

When the tile 400*a* is assembled, a leading edge 484 of each guide rail 482 is aligned with and inserted into a corresponding one of the open ends 468 of the guide slots 466. A vertical position of the upper wall 410 is then selected by sliding the upper wall 410 along the guide slot 466 of the lower wall 408 until the upper wall 410 is at the desired vertical position. While the illustrated example of the tile 400*a* shows the guide slot 466 formed in the lower wall 408 and the guide rail 482 formed in the upper wall 410, it will be appreciated that this interface may be reversed such that the guide rail 482 is formed on the lower wall 408 and the guide slot 466 is formed on the upper wall 410

The configuration of the front wall 404*a* (e.g., shortened, lengthened) may be secured by a vertical position interface 490 formed between the lower wall 408 and the upper wall 410. In the illustrated example, the vertical position interface 490 includes a plurality of vertical positioning elements 492 arranged in series in a vertical direction along the upper wall 410 and a corresponding vertical locking element 494 formed on the lower wall 408. In this example, the vertical positioning elements 492 include apertures 492 formed through the guide rail 482 and front panel 483 of the upper wall 410, while each vertical locking element 494 includes at least one aperture 494 formed through the guide slot 466 of the lower wall 408 and a fastener 496 configured to be inserted through the apertures 492, 494. While the apertures 492, 494 of the illustrated example are respectively formed through the guide slots 466 and guide rails 482, the apertures may be arranged in any area of the front wall 404*a* where the upper wall 410 and the lower wall 410 overlap, such as along the front panels 453, 483.

To set a desired vertical position of the upper wall 410, the upper wall 410 is moved along the guide slot 466 until the apertures 492, 494 corresponding to the desired configuration are aligned with each other. The fastener 496 is then inserted through the apertures 492, 494 to lock the vertical configuration of the front wall 404*a*. In the illustrated example, the fasteners 496 are embodied as threaded fasteners 496 including a pin 496*a* and a retainer 496*b* that is threadingly secured to a shaft of the pin 496*a*. In other examples, the fastener 496 may include a quick-release pin having a retractable bulb, or other configurations of pins.

With particular reference to FIGS. 28 and 29, an adjustable tile 400*b* is provided and includes the carriage 406, a lower wall 408*b* coupled to the carriage to define a base 402*b*, and an upper wall 410*b* attached to the lower wall 408*b* to form a front wall 404*b*. In view of the substantial similarity in structure and function of the components associated with the article of adjustable tile 400*a* with respect to the adjustable tile 400*b*, like reference numerals are used hereinafter and in the drawings to identify like components while like reference numerals containing letter extensions are used to identify those components that have been modified.

In the example of the adjustable tile 400*b* shown in FIGS. 28 and 29, lower wall 408*b* and the upper wall 410*b* include an integrated vertical position interface 490*b* operable to adjust and secure the relative positions of the lower wall 408*b* and the upper wall 410*b* without secondary fasteners (e.g., pins). In this example, the lower wall 408*b* includes a pair of sidewalls 454*b* each defining a guide rail 482*b* and a vertical positioning element 492*b*, while the upper wall 410*b* includes a pair of sidewalls 480*b* each configured to slidingly interface with the one of the sidewalls 454*b* and including a guide slot 466*b* and a vertical locking element 494*b*.

As shown in FIG. 28, the guide rail 482*b* of the lower wall 408*b* extends from a leading edge 484*b* at the upper end 452 of the lower wall 408*b*. The vertical positioning element 492*b* includes a plurality of detents 492*a* arranged in series along an inward-facing surface of the sidewall 454*b*. The guide slot 466*b* of the upper wall 410*b* extends from an open end 468*b* at the lower end 476 of the upper wall 410*b*. Here, the vertical locking element 494*b* is embodied as a resilient prong 494*b* extending from the lower end 476 of the upper wall 410*b* and configured to selectively engage one of the detents 492*b* formed on the lower wall 408*b*. For example, the resilient prong 494*b* may include a retainer or locking tooth 496*c* that is sized to be received within one of the detents 492*b*. The locking tooth 496*c* may include a beveled leading surface configured to bias the locking tooth 496*c* away from the detent 492*b* as the upper wall 410*b* moves towards the shortened configuration, and a locking surface formed on the opposite side (i.e., the top side) from the leading surface. The locking surface may be formed as an orthogonal or undercut feature configured to engage the detent to prevent movement of the upper wall 410*b* towards the lengthened configuration. In use, the resilient prong 494*b* is manually disengaged from the detents 492*b* by biasing the locking tooth 496*c* in a direction away from the detents (i.e., towards the center of the tile).

With particular reference to FIGS. 17 and 30, an assembly 10*b* is provided and includes the carriage the adjustable tiles 400*a* and a tile rail 300*a*. In view of the substantial similarity in structure and function of the components associated with the assembly 10*a* with respect to the assembly 10*b*, like reference numerals are used hereinafter and in the drawings to identify like components while like reference numerals containing letter extensions are used to identify those components that have been modified.

In FIG. 30, the assembly 10*b* includes a tile rail 300*a* configured to be mounted to the bottom side of the shelf 12. Thus, the assembly 10*b* may utilize any one of the adjustable tiles 400*a*, 400*b* in combination with a top-mounted tile rail 300*a*. Here, the tile rail 300*a* includes a tile track configured to receive the bearing rail 424 of the carriage 406, whereby the adjustable tile 400*a*, 400*b* can be translated along the tile rail 300*a* by sliding the carriage 406 within the tile track.

The following Clauses provide an exemplary configuration for a merchandise security system described above.

Clause 1. A merchandise security system for a retail shelf, the system including a divider rail, a tile rail selectively coupled with the divider rail, a divider engaged with the divider rail and at least partially defining a first product receiving area and a second product receiving area, and one or more tiles slidably engaged with the tile rail and operable to translate along the rail from a first position corresponding to the first product receiving area to a second position corresponding to the second product receiving area.

Clause 2. The system of Clause 1, wherein the one or more tiles are selectively engaged with the divider rail.

Clause 3. The system of Clause 2, wherein the divider includes a first set of teeth and the divider rail includes a second set of teeth, the first set of teeth being configured to selectively engage the second set of teeth.

Clause 4. The system of any of the preceding Clauses, wherein the tile rail includes a third set of teeth and the tiles each include one or more fingers configured to selectively engage the third set of teeth.

Clause 5. The system of Clause 5, wherein the selective engagement of the one or more fingers with the third set of teeth is configured to provide audible feedback when the one or more tiles are translated from the first position to the second position.

Clause 6. The system of any of the preceding Clauses, wherein the tile rail defines a tile track configured to receive each of the tiles, and each of the tiles include a bearing rail that is configured to engage the tile track.

Clause 7. The system of Clause 6, wherein the tile track and the bearing rail are both generally T-shaped.

Clause 8. The system of either of Clause 6 or Clause 7, wherein the tile track is defined by a pair of flanges that have a generally bulbous shape that is configured to reduce sliding friction between the guide rail and the flanges.

Clause 9. The system of any of the preceding Clauses, wherein the divider rail includes a rear wall and a front wall spaced apart from the rear wall by a channel, the front wall defining a slot configured to selectively receive a portion of the tile rail.

Clause 10. The system of Clause 9, wherein the slot includes a first terminal end defining a socket configured to provide a snap fit with the portion of the tile rail.

Clause 11. A tile for a merchandise security system, the tile including a base and a front wall attached to the base and operable between a retracted configuration where the front wall is spaced a first distance from the base and an extended configuration where the front wall is spaced a second distance from the base.

Clause 12. The tile of Clause 11, wherein the base includes a bottom wall having a bearing rail attached to a first side of the bottom wall.

Clause 13. The tile of Clause 12, wherein the base includes a sidewall extending from a second side of the bottom wall.

Clause 14. The tile of Clause 13, wherein the base includes a sidewall defining a receiver configured to slidably receive a portion of the front wall.

Clause 15. The tile of Clause 14, wherein the front wall includes a tongue slidably received within the receiver of the base.

Clause 16. The tile of any of the preceding Clauses, wherein the base defines an adjustment element configured to secure a configuration of the base in one of the extended configuration and the retracted configuration.

Clause 17. The tile of Clause 16, wherein the front wall includes a locking element configured to engage the adjustment element of the base to secure the configuration of the base in one of the extended configuration and the retracted configuration.

Clause 18. The tile of Clause 17, wherein the adjustment element includes a plurality of teeth arranged in series and the locking element includes a resilient prong including a locking feature selectively engaged with the plurality of teeth.

Clause 19. The tile of Clause 18, wherein at least one of the plurality of teeth and the locking feature includes a beveled surface configured to bias the locking feature away from the adjustment element as the front wall moves to the retracted configuration.

Clause 20. The tile of any of the preceding Clauses, wherein the base includes one or more resilient fingers extending in an opposite direction from the front wall.

Clause 21. A merchandise security system including a divider rail including a front wall including an accessory slot, a tile rail selectively engaged with the accessory slot and defining a tile track, and one or more tiles including a bearing rail that is slidably engaged with the tile track, the one or more tiles configured to translate along the tile rail.

Clause 22. The system of Clause 21, further including a divider selectively engaged with the divider rail.

Clause 23. The system of Clause 22, wherein the divider includes a first set of teeth and the divider rail includes a second set of teeth, the first set of teeth being configured to selectively engage the second set of teeth.

Clause 24. The system of any of the preceding Clauses, wherein the tile rail includes a third set of teeth and the tiles include a pair of fingers configured to selectively engage the third set of teeth.

Clause 25. The system of Clause 24, wherein the selective engagement of the pair of fingers with the third set of teeth is configured to provide audible feedback when the one or more tiles are translated along the tile rail.

Clause 26. The system of any of the preceding Clauses, wherein the tile track and the bearing rail are both generally T-shaped.

Clause 27. The system of any of the preceding Clauses, wherein the tile track is defined by a pair of flanges that have a generally bulbous shape that is configured to reduce sliding friction between the guide rail and the tile track.

Clause 28. The system of any of the preceding Clauses, wherein the divider rail, the tile rail, and the one or more dividers are configured to be installed on a base surface of a shelf.

Clause 29. The system of any of the preceding Clauses, wherein the front wall of the divider rail extends from a base of the divider rail and includes a first portion and a second portion spaced apart from the first portion to define an opening of the slot facing the base of the divider rail.

Clause 30. The system of Clause 29, wherein the slot extends from the opening to a terminal end defining a socket configured to provide a snap fit with the tile rail.

Clause 31. A tile for a merchandise security system, the tile including a base and a front wall attached to the base and operable between a shortened configuration where the front wall has a first height and a lengthened configuration wherein the front wall has a second height.

Clause 32. The tile of Clause 31, wherein the front wall includes a lower wall slidably attached to the base and an upper wall slidably attached to the lower wall.

Clause 33. The tile of Clause 32, wherein the lower wall includes one of a guide track and a guide rail and the upper wall includes the other of the guide track and the guide rail slidingly engaged with the one of the guide track and the guide rail of the lower wall.

Clause 34. The tile of either of Clause 32 or Clause 33, wherein the lower wall includes one of a vertical positioning element and the upper wall includes a vertical locking element selectively engaged with the vertical positioning element to secure a vertical position of the upper wall relative to the lower wall.

Clause 35. The tile of Clause 34, wherein the vertical positioning element includes a plurality of apertures and the vertical locking element includes a fastener engaged with one of the plurality of apertures.

Clause 36. The tile of Clause 35, wherein the fastener is a pin.

Clause 37. The tile of either of Clause 35 or Clause 36, wherein the fastener is a resilient prong coupled to one of the upper wall or the lower wall.

Clause 38. The tile of any of Clauses 32-37, wherein the base includes a carriage having a bearing rail.

Clause 39. The tile of Clause 38, wherein the carriage includes a receiver and the lower wall includes a tongue slidingly received within the receiver of the carriage.

Clause 40. The tile of either of Clause 38 or Clause 39, wherein the lower wall is operable to move between an extended configuration and a retracted position.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed herein could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A merchandise security system for a retail shelf, the system comprising:

a divider rail including a divider rail base, a divider rail rear wall extending from a first side of the divider rail base, a divider rail front wall extending from an opposite side of the divider rail base to define a channel between the divider rail rear wall and the divider rail front wall, and a divider rail slot formed within the divider rail front wall;

a tile rail including a front tile rail wall and a rear tile rail wall received within the divider rail slot of the divider rail front wall;

a divider engaged with the channel of the divider rail and at least partially defining a first product receiving area and a second product receiving area; and one or more tiles slidably engaged with the tile rail and operable to translate along the tile rail from a first position corresponding to the first product receiving area to a second position corresponding to the second product receiving area.

2. The system of claim 1, wherein the one or more tiles are engaged with the divider rail.

3. The system of claim 1, wherein the divider includes a first set of teeth and the divider rail includes a second set of teeth, the first set of teeth being configured to selectively engage the second set of teeth.

4. The system of claim 3, wherein the tile rail includes a third set of teeth and the tiles each include one or more fingers engaged with the third set of teeth.

5. The system of claim 4, wherein the engagement of the one or more fingers with the third set of teeth provides an audible feedback when the one or more tiles are translated from the first position to the second position.

6. The system of claim 1, wherein the tile rail further includes a middle tile rail wall disposed between the front tile rail wall and the rear tile rail wall, a tile track extending between the front tile rail wall and the middle tile rail wall and configured to receive each of the tiles, and each of the tiles include a bearing rail that is configured to engage the tile track.

7. The system of claim 6, wherein the tile track and the bearing rail are both T-shaped.

8. The system of claim 6, wherein the tile track is defined by a pair of flanges that have a generally bulbous shape that is configured to reduce sliding friction between the bearing rail and the flanges.

9. The system of claim 1, wherein the divider rail slot includes a first terminal end defining a socket providing a snap fit with the tile rail rear wall.

* * * * *